US006456816B1

(12) United States Patent
Chowdry et al.

(10) Patent No.: US 6,456,816 B1
(45) Date of Patent: Sep. 24, 2002

(54) METHOD AND APPARATUS FOR AN INTERMEDIATE IMAGE TRANSFER MEMBER

(75) Inventors: Arun Chowdry; Steven Cormier; John W. May, all of Rochester; Borden H. Mills, Webster; Bonnie Patterson, Rochester; David J. Quesnel, Pittsford; Donald S. Rimai, Webster; Kenneth D. Stack, Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/680,136

(22) Filed: Oct. 4, 2000

(51) Int. Cl.[7] ..... G03G 15/01
(52) U.S. Cl. ..... 399/302
(58) Field of Search ..... 399/107, 297, 399/302, 308

(56) References Cited

U.S. PATENT DOCUMENTS

| | | | | |
|---|---|---|---|---|
| 3,854,975 A | * | 12/1974 | Brenneman et al. | 399/339 X |
| 3,863,603 A | | 2/1975 | Buckley et al. | 118/637 |
| 3,959,574 A | | 5/1976 | Seanor et al. | 428/425 |
| 3,983,287 A | | 9/1976 | Goosen et al. | 428/241 |
| 4,023,967 A | | 5/1977 | McGibbon | 96/1 LY |
| 4,255,508 A | | 3/1981 | Kuehnle | 430/94 |
| 4,378,622 A | | 4/1983 | Pinkston et al. | 29/148.4 D |
| 4,531,825 A | | 7/1985 | Miwa et al. | 355/3 TR |
| 4,601,963 A | | 7/1986 | Takahashi et al. | 430/69 |
| 4,791,275 A | | 12/1988 | Lee et al. | 219/469 |
| 4,894,687 A | * | 1/1990 | Beaudet | 399/107 X |
| 4,899,197 A | | 2/1990 | Davis et al. | 355/290 |
| 5,038,178 A | | 8/1991 | Hosoya et al. | 355/277 |
| 5,143,573 A | | 9/1992 | Ammon et al. | 156/294 |
| 5,227,853 A | | 7/1993 | Proulx et al. | 355/282 |
| 5,258,809 A | | 11/1993 | Wiedemer | 355/200 |
| 5,298,956 A | | 3/1994 | Mammino et al. | 355/275 |
| 5,335,054 A | | 8/1994 | Landa et al. | 355/279 |
| 5,376,999 A | | 12/1994 | Hwang | 355/326 R |
| 5,386,273 A | | 1/1995 | Wood et al. | 355/212 |
| 5,415,961 A | | 5/1995 | Yu et al. | 430/58 |
| 5,418,600 A | | 5/1995 | Genovese | 355/200 |
| 5,438,398 A | | 8/1995 | Tanigawa et al. | 355/271 |
| 5,497,222 A | | 3/1996 | Landa et al. | 355/279 |
| 5,508,789 A | | 4/1996 | Castelli et al. | 355/208 |
| 5,519,475 A | | 5/1996 | Miyamoto et al. | 355/271 |
| 5,553,541 A | | 9/1996 | Vrotacoe et al. | 101/217 |
| 5,592,269 A | | 1/1997 | Youses et al. | 399/237 |
| 5,636,349 A | | 6/1997 | Landa et al. | 399/307 |
| 5,669,045 A | | 9/1997 | Swain | 399/159 |
| 5,704,291 A | | 1/1998 | Lewis | 101/457 |
| 5,722,016 A | | 2/1998 | Godlove et al. | 399/159 |
| 5,745,829 A | | 4/1998 | Gazit et al. | 399/302 |
| 5,790,930 A | | 8/1998 | Fuschiwaki | 399/302 |
| 5,894,796 A | | 4/1999 | Gelinas | 101/219 |
| 5,926,679 A | * | 7/1999 | May et al. | 399/297 X |
| 5,946,525 A | | 8/1999 | Okamura et al. | 399/66 |
| 6,044,243 A | | 3/2000 | Hara | 399/302 |
| 6,075,965 A | | 6/2000 | Tombs et al. | 399/308 |

FOREIGN PATENT DOCUMENTS

| | | | |
|---|---|---|---|
| EP | 0 590 924 A1 | 9/1993 | G03G/15/00 |
| EP | 0 928 999 A2 | 1/1999 | G03G/13/09 |
| JP | 3133695 | 6/1991 | B41N/10/02 |
| JP | Hei. 81996-114997 | 5/1996 | G03G/15/16 |
| WO | WO 98/04961 | 2/1998 | G03G/15/16 |

* cited by examiner

*Primary Examiner*—Fred L Braun
(74) *Attorney, Agent, or Firm*—James D. Leimbach

(57) ABSTRACT

An intermediate transfer roller that functions as an image receiving member within a reproduction apparatus having a rigid cylindrical core member and at least one layer of an elastically deformable structure surrounding the core member, the elastically deformable structure preferably has an effective Poisson's ratio in the range of 0.2 to 0.4.

20 Claims, 7 Drawing Sheets

METHOD AND APPARATUS FOR AN INTERMEDIATE IMAGE TRANSFER MEMBER

CROSS REFERENCE TO RELATED APPLICATIONS

Reference is made to the commonly assigned U.S. Patent Applications, the disclosures of which are incorporated herein by reference.

U.S. patent application Ser. No. 09/679,016, filed Oct. 4, 2000, in the names of Arun Chowdry et al, entitled DOUBLE-SLEEVED ELECTROSTATOGRAPHIC ROLLER AND METHOD OF USING.

U.S. patent application Ser. No. 09/679,113, filed Oct. 4, 2000, in the names of Robert Charlebois et al, entitled INTERMEDIATE TRANSFER MEMBER HAVING A STIFFENING LAYER AND METHOD OF USING.

U.S. patent application Ser. No. 09/679,177, filed Oct. 4, 2000, in the names of Muhammed Aslam et al, entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al, entitled EXTERNALLY HEATED DEFORMABLE FUSER ROLLER.

U.S. patent application Ser. No. 09/680,133, filed Oct. 4, 2000, in the names of Arun Chowdry et al, entitled SLEEVED PHOTOCONDUCTIVE MEMBER AND METHOD OF MAKING.

U.S. patent application Ser. No. 09/680,134, filed Oct. 4, 2000, in the names of Muhammed Aslam et al, entitled SLEEVED ROLLERS FOR USE IN A FUSING STATION EMPLOYING AN EXTERNALLY HEATED FUSER ROLLER.

U.S. patent application Ser. No. 09/680,135, filed Oct. 4, 2000, in the names of Jiann-Hsing Chen et al, entitled TONER FUSING STATION HAVING AN INTERNALLY HEATED FUSER ROLLER.

U.S. patent application Ser. No. 09/680,139, filed Oct. 4, 2000, in the names of Robert Charlebois et al, entitled INTERMEDIATE U.S. patent application Ser. No. 09/680,138, filed Oct. 4, 2000, in the names of Jiann-Hsing Chen et al, entitled TONER FUSING STATION HAVING AN EXTERNALLY HEATED FUSER ROLLER.

FIELD OF THE INVENTION

This invention relates to electrostatography and, more particularly, to a reproduction method and apparatus that employs transfers of toner images to and from intermediate transfer members.

BACKGROUND OF THE INVENTION

In an electrophotographic process a photoconductive element is initially electrically charged. An electrostatic latent image is first formed by image-wise exposing the photoconductive element using an exposure source such as a laser scanner or an LED array. The latent image is developed into a visible image by bringing the electrostatic latent image into close proximity to a developer such as contained in a magnetic brush or other known type of development station. The developer can be what is typically referred to as a single component developer containing toner particles. Also, the developer can have two or more components with nonmarking magnetic carrier particles and marking non-magnetic toner particles. To produce color images, electrostatic latent images corresponding to the appropriate color are separately formed and developed. The resulting toner images are transferred to a receiver, such as a paper or a plastic sheet for example, preferably by using an electrostatic field to urge the toner in the direction of the receiver. The electrostatic field is commonly applied in one of several manners. For example, charge can be sprayed on to the back of a receiver using a corona device. However, it is frequently preferable to use an electrically biased transfer roller to apply the field, especially in instances where color images are to be produced.

It is often advantageous to transfer a toner image from an imaging member to an intermediate transfer member (ITM) in a first transfer nip, and from ITM to a receiver, e.g., paper, in a second transfer nip, rather than transferring directly from imaging member to a receiver. The second nip can be formed in a variety of ways, such as utilizing a biased transfer drum wrapped in a tensioned, electrically biasable transport web to which a receiver sheet is attached, or by using a dielectric transport web and an electrically biasable backup transfer roller. Color images are produced by developing and transferring toner images corresponding to the appropriate color separations. For example, to produce a full-color image, color separations having cyan, magenta, yellow and black toners typically are used. Color separation toner images are commonly transferred sequentially, in a registered manner, to an ITM and, subsequently, the complete color toner image is transferred from the ITM to a receiver in one step. Alternatively, individual color toner separation images can be transferred to separate ITMs, or to different sections of a single ITM, and then transferred in register to a receiver in multiple steps. Following a final toner transfer, a toner image on a receiver is permanently fixed using known processes such as thermal or radiant fusing.

In an electrographic process, a latent electrostatic image is created on a dielectric imaging member, e.g., by ionography or by electrified stylus or by other known means, and then toned. The resulting toner image, which can be a color separation image, can then be transferred to an ITM, and subsequently transferred to a receiver and fused as described above. An electrographic press can include a sequential series of modules, each module having an electrographic dielectric imaging member and an ITM for generating and transferring a color separation toner image to a receiver.

The nip is an engagement area of a roller under pressure with another member. This engagement area will result in some deformation. Pressure nips formed by rollers coated with elastomers are known to exhibit overdrive. Overdrive is the phenomena where the tangential speed of a roller within the nip engagement area is actually different than the tangential speed of the roller in an area not near the nip. Overdrive can be understood from a hypothetical consideration of a roller having an externally driven axle, frictionally driving a movable planar element having a nondeformable surface. If the external radius of the roller in an area not near the nip is R and the tangential speed of the roller in this area not near the nip is $v_0$, then the surface velocity v of the distorted portion of the roller which is in nonslip contact with the planar surface is given by Equation 1.

$$v=\lambda\omega R \qquad \text{Equation 1}$$

where ω is the nominal angular rotational rate of the roller around its axis (radians per unit time) and where λ is a peripheral speed ratio defined by $$\lambda=(v/v_0).$$

The value of $\lambda$ is determined principally by the roller materials effective Poisson's ratio and moduli, by the engagement and drag torque forces. The Poisson ratio, $\nu$, of high polymers (those having a high molecular weight) approaches 0.5, and approaches zero for very soft polymeric foams. It has been shown in theoretical model computations by K. D. Stack, *Nonlinear Finite Element Model of Axial Variation in Nip Mechanics with Application to Conical Rollers* [Ph.D. Thesis, University of Rochester, Rochester, N.Y. (1995), FIGS. 5–6 and 5–7, pages 81 and 83] that for a special case of a rigid cylindrical roller coated by a layer of deformable material frictionally driving with no drag, a nondeformable moving planar element, the deformable material should have a value of Poisson's ratio of about 0.3 in order to have negligible overdrive, i.e., $\lambda \approx 1$. For values of Poisson's ratio larger than about 0.3, the circumference of the roller (distorted by the nip) is greater than $2\pi R$, producing overdrive of the planar element with respect to the roller, i.e., the surface speed within the nip of the coated roller (and hence that of the planar element) is greater than $v_0$. For values of Poisson's ratio smaller than about 0.3, the circumference of the roller is less than $2\pi R$, producing underdrive of the planar element with respect to the roller, i.e., the surface speed is smaller than $v_0$ within the nip. Conversely, if a nondeformable planar element frictionally drives, with negligible drag, a roller having $\nu$ less than about 0.3 and causes it to rotate, one can speak of overdrive of the roller with respect to the planar element because the surface speed of the driven roller far from the nip is faster than the speed of the planar element.

A foam or sponge can include a "felted" material, as is well known in the art. Felted foams can be made, for example, by compressing under heat, typically uniaxially, an elastomeric, previously made foam, followed by cooling it under compression and then removing the compressive load. Felted foams have anisotropic mechanical properties. For example, both the Young's modulus and Poisson's ratio of a felted foam material made by uniaxial compression will be different along the direction of compression that lies in a plane at right angles to the direction of compression. Moreover, Poisson's ratio, which tends to be small for soft foams, can even take on negative values in felted foams or sponges.

Overdrive associated with two materials in contact in a pressure nip can result in squirming and undesirable stick-slip behavior. Such behavior can adversely affect image quality when more than one intermediate transfer member is used to make a color print in a color reproduction machine, e.g., by degrading the mutual registration of color separation images if the amount of overdrive produced by each ITM roller varies from roller to roller, or, by causing toner smear. Moreover, variations in overdrive from a given roller, sometimes referred to as "differential overdrive", can occur axially or radially along the length of a transfer nip, such variations being produced, for example, by local changes in engagement, such as caused by runout, or by a lack of parallelism, or by variations of dimensions of the members forming a transfer nip.

An electrophotographic printing press can include a number of modules, one module for each color separation. Each module includes, for example, a photoconductive drum and an ITM in the form of a drum, e.g., forming a cyan toner image in module 1, a magenta image in module 2, a yellow image in module 3, and a black image in module 4. Each photoconductive drum has a primary charging station, an exposure station using a digital writer such as a laser scanner or LED array, a developing station, and a transfer station having a pressure nip where toner is electrostatically transferred to an appropriately electrically biased ITM drum, and a cleaning station. A receiver sheet, e.g., a paper sheet or a plastic transparency, is transported through successive modules, and the individual color separation toner images are successively transferred in register, from the successive ITMs of each module, to a receiver, e.g., paper, in successive transfer stations. Each transfer station, where a color toner image is transferred from an ITM to a receiver, includes a pressure nip formed with a suitably electrically biased transfer roller (backup roller) behind the receiver. A full-color toner image on a receiver is then sent to a fusing station where the toner is fused to the receiver. If, in practice, there is unregulated overdrive in the modules (the magnitude of overdrive can vary in degree from module to module) it is possible in principle to optimize registration (which is determined by the exact time of transfer from each ITM drum to receiver) by timing the writing of each latent image on each photoconductor drum, for example by sensing the location of an edge or a fiducial mark on a receiver sheet as it is transported from module to module. This can be costly, cumbersome and inconvenient. However, if there is also differential overdrive, then radial and axial variations of overdrive along a nip cannot be compensated for in such a manner, and the result can be unwanted losses of registration (and possible localized image smearing) in portions of a toned print. It should also be noted that significant drag forces result from the various contacting interfaces between drums and other elements in a module. These drag forces, which affect the amount of overdrive, can have time-dependent fluctuations which can also produce registration errors.

In making high quality images using small toners uses of compliant ITMs are disclosed, for example, in: Rimai et al., U.S. Pat. No. 5,084,735; Ng et al., U.S. Pat. No. 5,110,702; Zaretsky, U.S. Pat. No. 5,187,526; Rimai et al, U.S. Pat. No. 5,666,193; and Tombs et al., U.S. Pat. No. 5,689,787. The benefits of employing compliant ITMs are well known, especially as pertaining to their use with small toner particles. Small toner particles are defined as toner particles having a mean volume weighted diameter of between 2 micrometers and 9 micrometers, as determined by a suitable commercial particle sizing device such as a Coulter Multisizer. A prior art compliant ITM such as cited above in U.S. Pat. Nos. 5,084,735; 5,110,702; 5,187,526; 5,666,193; and 5,689,787 typically includes an elastomeric layer preferably between 1 mm and 25 mm in thickness, having a Young's modulus between 1 MPa and 50 MPa and having an electrical resistivity between $10^6$ ohm-cm and $10^{12}$ ohm-cm, preferably $10^7$ ohm-cm to $10^9$ ohm-cm. It is preferable that such a prior art compliant intermediate also include a relatively thin (0.1 mm to 20 mm thick) overcoat layer having a material whose Young's modulus is greater than 100 MPa. Young's modulus is determined on a macroscopic-size sample of the same material using standard techniques, such as by measuring the strain of the sample under an applied stress using a suitable commercial device such as an Instron Tensile Tester and extrapolating the slope of the curve back to zero applied stress.

The use of a common gear to provide equal rotational speeds (peripheral speeds) of an ITM and a PC is disclosed in U.S. Pat. No. 5,390,010 issued to Yamahata et al.,. There is a shortcoming within Yamahata et al.,. in that it does not solve problems due to overdrive, such as stick-slip motion that can results from elastic strain windup in one or both members forming a transfer nip, i.e., when (peripheral) speeds of members forming a nip are constrained to be equal and yet a nonequal speed is demanded by the overdrive physics.

M. Toshio et al., in U.S. Pat. No. 5,519,475, discloses a differential motion that produces a slip between a PC drum and an ITM in order to improve the transfer of toner. The embodiments disclosed employ gears to provide the differential motion. Specifically, the invention of M. Toshio et al., in U.S. Pat. No. 5,519,475 relates to a peripheral speed difference between PC and ITM in a range of 0.5% to 3.0%. See also Tanigawa et al., U.S. Pat. No. 5,438,398.

A fairly recent patent issued to S. Badesha et al., U.S. Pat. No. 5,576,818, and assigned to Xerox, discloses a multiple layer ITM having an electrically conductive substrate, a conformable and electrically resistive layer including of a first polymeric material, and a toner release layer having a second polymeric material. Also Toshio et al., in U.S. Pat. No. 5,519,475, disclose a multiple layer ITM having a conductive core, an intermediate resistance elastic layer, and a smooth, intermediate resistance outer layer which can include a different polymer.

Tanigawa et al., in U.S. Pat. No. 5,438,398, disclose an intermediate member having a metal pipe core covered by a single layer of an elastic material which can include a foam. The elastic material is 8 mm thick, contains dispersed carbon or zinc oxide or the like and has resistivity $10^5$ ohm-cm–$10^{11}$ ohm-cm. The elastic layer has 20° to 40° Asker C hardness. In a transfer nip for transfer of toner to a receiver sheet, the transfer roller is relatively much harder, made of a conductive core and a thin outer layer of a fluorinated resin having thickness 20 micrometers–100 micrometers. Also disclosed is a roller, which functions as an ITM for color imaging, whereby individual color toner images are successively electrostatically transferred to the ITM to build a full-color image on the ITM. Following this, a receiver sheet is passed through the same nip with the electric field direction in the nip reversed, thereby transferring the full-color toner image to the receiver, during which time the PC drum acts, in effect, as a transfer roller. The ITM has a metal core, an electrically conductive elastic layer having resistivity $10^3$ ohm-cm–$10^6$ ohm-cm, and a thin outer layer having resistivity $10^7$ ohm-cm–$10^{11}$ ohm-cm. The electrically conductive elastic layer can be a foamed EPDM (ethylene propylene diene monomer) layer having dispersed carbon particles to give a resistivity of $10^3$ ohm-cm, and the outer layer can be a low surface energy material, e.g., polyvinylidene fluoride containing tin oxide and having a resistivity of $10^9$ ohm-cm. The hardness of the ITM roller is 35° Asker C, i.e., the foam layer is quite soft and therefore significant overdrive is to be expected in a nip formed with the other, relatively hard, roller.

In order to achieve high image quality in respect to registration and lack of image smear in electrostatography, and in particular electrophotography, there is a need to provide an ITM in the form of a roller or a drum producing predictable and controllable overdrive behavior as a function of engagement in a nip of predetermined geometry. In particular, there is a need to provide an ITM for which overdrive is at most weakly dependent, and preferably independent, of engagement, not only in a first transfer nip with a relatively hard PC roller or drum, but also in a second transfer nip with a receiver backed by a relatively hard transfer roller. There is yet a further need to minimize overdrive sensitivity to engagement variations and other process noises, such as for example produced by runout such as produced by roller eccentricity or acentricity, or by a lack of parallelism or by variations of dimensions of the members or components of the members forming a transfer nip. There is a still further need to provide an ITM such that its overdrive (or underdrive) characteristics are insensitive to changes in drag, such as for example can be produced when a receiver sheet enters a second transfer nip.

SUMMARY OF THE INVENTION

The foregoing needs are satisfied by an ITM according to the invention that provides a method and apparatus of reducing both overdrive and differential overdrive associated with an intermediate transfer member roller of an electrostatographic color reproduction machine. The main benefit is a reduced sensitivity to fluctuations of engagement associated with roller runout, mounting tolerance errors, and the like. The invention provides an improved registration of color separation toner images, and an improved fidelity of reproduction with minimal distortion of an original or input image to be reproduced.

In accordance with the invention, there is provided an intermediate transfer roller for use in electrostatography including a method and apparatus for an intermediate transfer roller for use in electrostatography wherein a rigid cylindrical core member is provided then surrounded by an elastically deformable structure having a Poisson's ratio in a range of 0.2 to 0.4. Preferably, the elastically deformable structure surrounding the core member has a conformable layer surrounding the core member, a compliant blanket layer surrounding and adhered to the conformable layer, and a thin hard outer layer formed on the compliant blanket layer. A thin flexible electrically conductive electrode layer adhered to the conformable layer is also discussed.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus can be modified. For clarity of understanding, the relative proportions of the drawings as depicted can have selective exaggeration of the various elements which can not be representative of the actual proportions of those selected elements.

FIG. 1(*b*) is a schematic side view, not to scale, of a four-module electrophotographic color reproduction apparatus utilizing intermediate transfer members of the invention and a common backing drum member for transfer of toner images to receivers;

FIG. 1(*c*) is a schematic side view, not to scale, of an electrophotographic four-module color reproduction apparatus in which each module uses a common intermediate transfer member of the invention to serially receive color separation toner images for subsequent simultaneous transfer to a receiver;

FIG. 2(*b*) is a schematic cross sectional view, not to scale, of a second embodiment of an inventive roller having a conformable layer surrounded by a stiffening layer, the stiffening layer having formed on it a compliant blanket layer;

DETAILED DESCRIPTION OF THE PREFERRED EMBODIMENTS

Figure 1A:
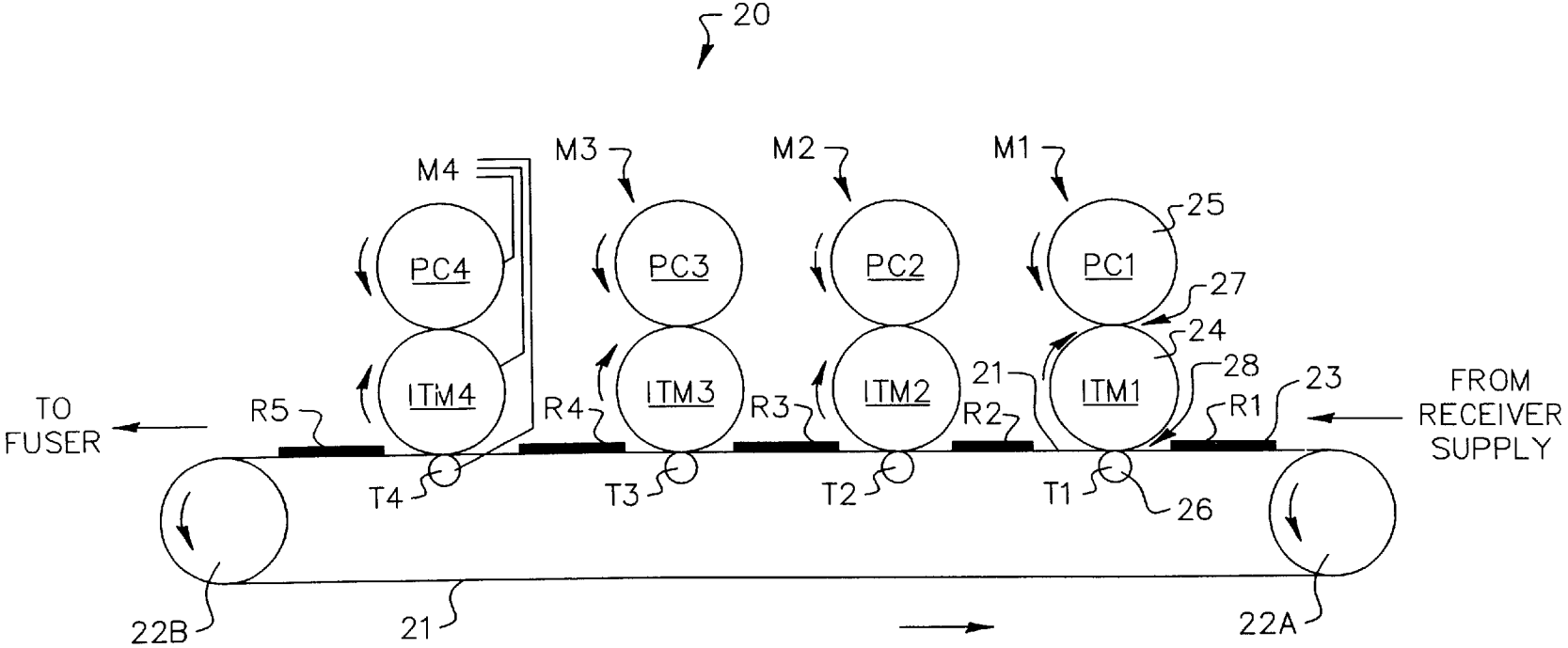
FIG. 1(*a*) is a schematic side view, not to scale, of a four-module electrophotographic color reproduction apparatus utilizing intermediate transfer members of the invention in conjunction with a transport belt for receiver members.

The invention discloses novel intermediate transfer members that are useful for full color electrostatography, and especially, full color electrophotography utilizing one or more single color toner images, whereby each single color toner image is formed on a primary image-forming member (PIFM) and transferred in a first transfer step to a novel intermediate transfer member (ITM) having a deformable structure having an effective or operational Poisson's ratio near about 0.3. Subsequently, the toner image is transferred in a second transfer step to a receiver, e.g., a paper or a plastic sheet. As an alternative to electrophotographic recording, there can be used electrographic recording of each primary color image using stylus recorders or other known recording methods for recording a toner image on a PIFM which can include a dielectric member, the toner image to be transferred electrostatically via an ITM as described herein. Broadly, the primary image is formed using electrostatography, and a PIFM can include a web or a drum.

As disclosed by Tombs and Benwood in U.S. Pat. No. 6,075,965, single color toner images are sequentially transferred in registry to a receiver sheet carried on a moving transport web through a series of corresponding single color tandem modules. Each single color module includes a rotating compliant ITM roller and a counter-rotating PIFM roller. In each module, the moving transport web can frictionally drive the ITM roller, causing the ITM to rotate, while the ITM in turn can frictionally drive the PIFM, causing the PIFM to rotate. It will be appreciated that with a frictional drive, the compliant character of the ITM will tend to cause the ITM to be underdriven by a relatively unyielding transport web (backed by a roller), and will also tend to cause the ITM to overdrive a relatively hard PIFM. In a machine having, for example, four successive modules, it will be further appreciated that the amounts of overdrive (or underdrive) in each module will tend to differ to some degree, inasmuch as there can be slightly different engagements between members or slightly different roller dimensions in the individual modules, e.g., arising from tolerance errors or ambient temperature differences. These differences in module-to-module amounts of overdrive (or underdrive) can cause significant color shifts and other registration errors between transferred single color toner images overlaid on a receiver sheet. Moreover, overdrive in a given nip can exhibit variations known as differential overdrive, which can occur axially or radially along the length of a transfer nip, and these variations can be caused, for example, by local changes in engagement, such as caused by runout, or by a lack of parallelism of roller axes, or by irregularities of the dimensions of the members forming a transfer nip.

Implementation of an inventive ITM roller improves upon that disclosed by U.S. Pat. No. 6,075,965 by drastically reducing absolute amounts of overdrive (or underdrive), thereby dramatically reducing the inherent propensity for module-to-module registration errors. More importantly, the present invention also improves registration in an electrophotographic color reproduction machine by suppressing differential overdrive, thereby reducing overdrive sensitivity to tolerancing errors, mechanical impulse transients, and ambient fluctuations.

The invention is particularly useful for producing color images, especially full color images. Thus it can be desirable to produce a full color image, e.g., from primary colored cyan, magenta, yellow, and black toners, or from other single color toners. It is advantageous to print such images by serially connecting multiple modules together in a press. A preferred embodiment of a four-module press is indicated by the numeral 20 in FIG. 1(*a*), wherein each module includes an ITM of the invention and is capable of producing an image with one of the single color toners. More or fewer than four modules can be used. For example, a first module, indicated as M1, includes a PIFM in the form of a first photoconductive drum (PC1) 25 which could also be a roller, and a first intermediate transfer member (ITM1) 24 which can be either a drum or roller. The other modules are similarly constructed with each module including a photoconductive drum, an inventive ITM, and a transfer backup drum or roller, as for example indicated for Module 4 in FIG. 1(*a*). Module 1 produces for example a cyan toner image. In this instance, a photoconductive drum 25 rotating counterclockwise as shown is charged by suitable charging means (not shown) and then image-wise exposed using an LED array, laser scanner, optical exposure, or other suitable means (not shown). The image is then developed by bringing the electrostatic latent-image bearing PC1 into proximity of an electrophotographic developer such as contained in a development station in the same module (not shown). It is preferable to use a so-called "two-component" developer wherein one of the components includes magnetic carrier particles and the other component includes the toner particles. The cyan toner image is then electrostatically transferred in a first transfer nip 27 to intermediate a first transfer member (ITM1) 24, which rotates clockwise. PC1 25 is subsequently cleaned in a cleaning station (not shown) before charging and imagewise to create another latent electrostatic image. A receiver sheet (R1) 23 is transported from a receiver supply unit (not shown) and adhered, preferably electrostatically, to a transport belt 21 which is moved to the left, e.g., by counterclockwise rotation of rollers 22A and 22B which are provided with a motor drive. Receiver sheet 23, which can be a paper or a plastic transparency sheet, arrives in the second transfer nip 28 where the cyan toner image is electrostatically transferred to R1, using a backup transfer roller (T1) 26. The inventive ITM1 includes an elastically deformable surface structure having one or more layers, having an effective or operational Poisson's ratio between 0.2 and 0.4, preferably between 0.25 and 0.35, and more preferably between 0.28 and 0.32. The elastically deformable surface structure produces suitable nip contact widths to provide high efficiency transfers of toner, from PC1 to ITM1 and from ITM1 to the receiver R1. To build up a full-color print on a receiver, other single color toner images (e.g., magenta, yellow and black) are sequentially transferred in otherwise similar modules M2, M3 and M4 to the receiver as it is transported from one module to another. Additional modules can be added if desired. When the cyan image is being transferred to R1 in M1, other color separation images are being transferred to receivers R2, R3 and R4 in modules M2, M3 and M4, respectively. A completed full-color print, e.g., R5 is transported to a fuser in a fusing station (not shown) wherein the toner image is permanently fixed to the receiver. The transfer of the toner image transferred from an ITM to the receiver in a given module must be accomplished at a specific time. The specificity can be accomplished by adjusting the timing of the exposure used to form each of the electrostatic latent images (such as by using a fiducial mark laid down on a receiver) or by sensing the position of an edge of a receiver at a known time as it is transported through the machine at a known speed. While it is possible to some extent to adjust the timing of exposures in order to overcome misregistration errors (those caused by mismatched overdrives produced in successive modules characteristic of the apparatus of U.S. Pat. No. 6,075,965) it is much more difficult to correct for differential overdrive (electronically, as in each laser writer). However, employing ITMs according to the present invention substantially obviates the need to correct the exposure system for differential overdrive.

Figure 1B:
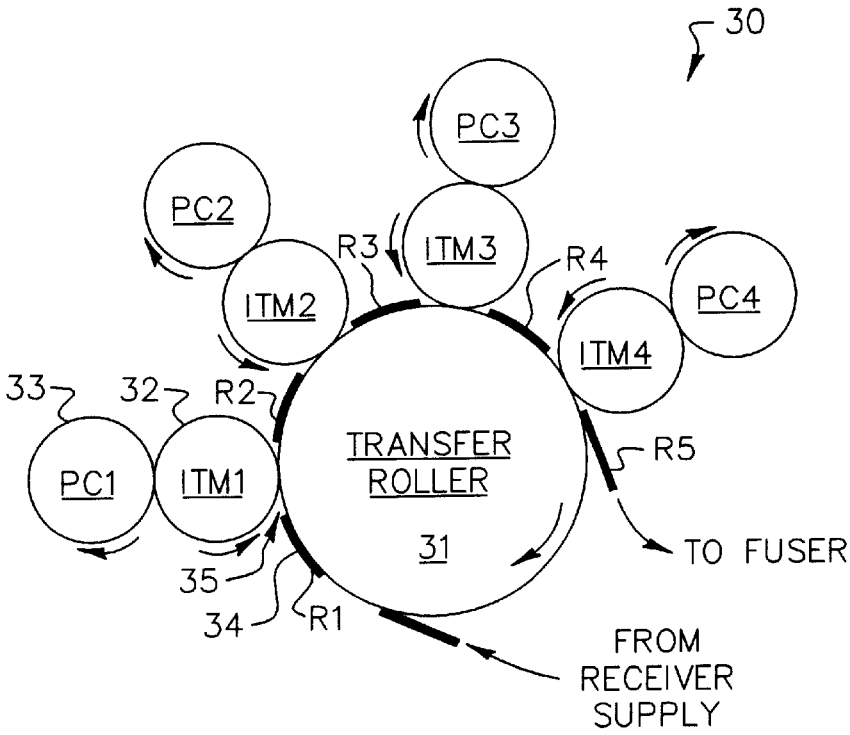
Figure 1C:
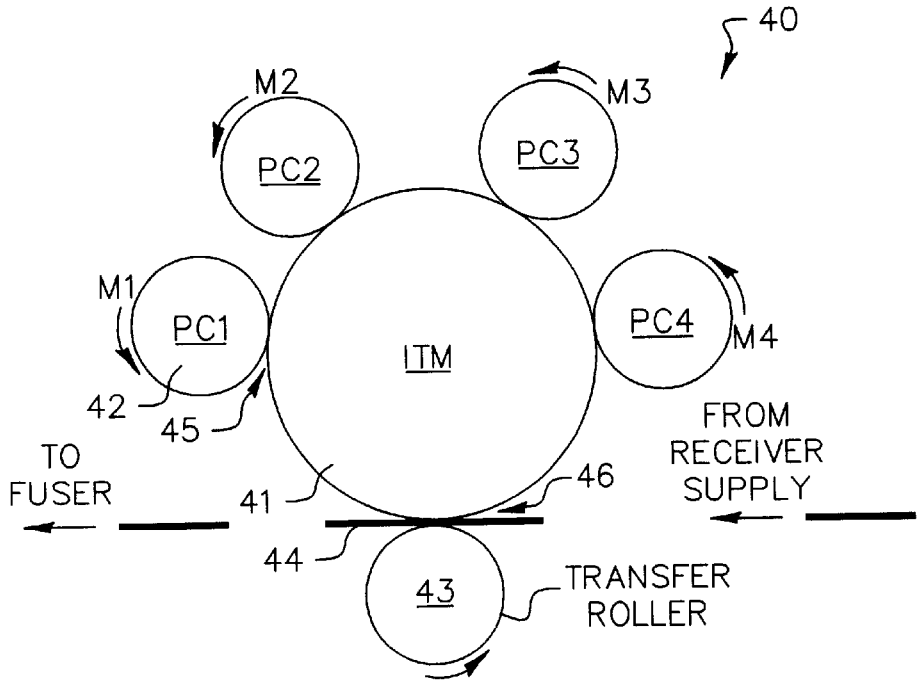

The elastically deformable surface structure of an ITM of FIG. 1(*a*) can have a thin hard outer layer.

The elastically deformable surface structure of an ITM of FIG. 1(*a*) can include a conformable layer, an optional thin flexible electrically conductive electrode layer adhered to the conformable layer, a compliant blanket layer surrounding and adhered to the electrode layer, and a thin hard outer layer coated on the blanket layer, wherein the Poisson's ratio of the conformable layer has a value less than 0.4, preferably in a range between 0.20 and 0.35, and the Poisson's ratio of the compliant blanket layer has a value between 0.4 and 0.5, preferably between 0.45 and 0.50. It is preferred that the compliant blanket layer be substantially incompressible.

The elastically deformable surface structure of an ITM of FIG. 1(*a*) can be formed on a strengthening band to create a sleeve member which removably and replaceably non-adhesively surrounds and intimately contacts the core member.

Figure 9:
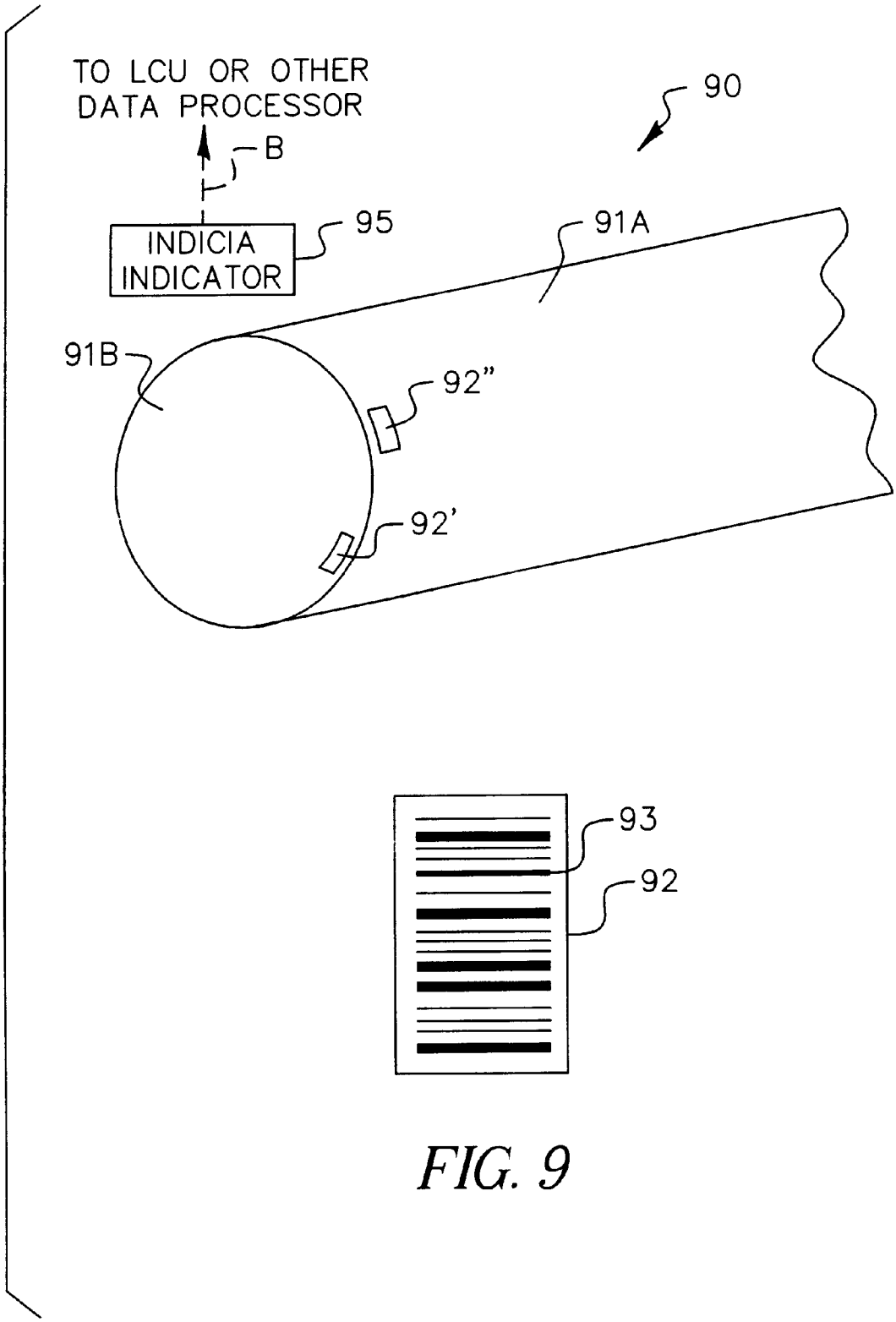
FIG. 9 is a sketch of the outside of an inventive ITM roller having marked on its outer surface a descriptive indicia located in a small area located close to an end of the roller.

FIG. 9 shows a sketch of an ITM roller 90 in accordance with the present invention, having a set of descriptive markings, or indicia, on the outer surface of the roller. These indicia are envisioned as being used to give parametric information relative to the roller. The outer surface can correspond to an outer surface of a roller 90 having a sleeve member, in which case the outer surface of the roller is the outer surface of the sleeve member. The indicia are located in a small area 92" located on a portion 91A of the cylindrical surface close to an end of the roller. More preferably, the indicia are contained in a small area 92' located on an end portion 91B of the roller, with area 92' preferably near the edge or rim (the individual layers including roller 90 are not shown). In the case of 90 being a sleeved roller, area 92' is preferably located on the edge of the sleeve. In the case of a sleeved roller, it can also be useful to provide indicia on an inner surface of a sleeve member, or on the surface of a member directly underneath the sleeve member. When an indicia is provided on a member directly underneath the sleeve member, it can also be useful to provide an opening or cutaway in the sleeve member to allow the indicia to be detected with the sleeve member in operational position. An enlarged view 92 of either of the small areas 92' or 92" illustrates that the descriptive indicia can be in the form of a bar code, as indicated by the numeral 93, which can be read, for example, by a scanner. The scanner can be mounted in an electrophotographic machine so as to monitor an inventive ITM roller, e.g., during operation of the machine or during a time when the machine is idle, or the scanner can be externally provided during installation of, or during maintenance of, an inventive roller. Generally, the indicia can be read, sensed or detected by an indicia detector 95. As indicated in FIG. 9 by the dashed arrow labeled B, the analog or digital output of the indicia detector can be sent to a logic control unit (LCU) incorporated in an electrostatographic machine utilizing an inventive ITM roller, or it can be processed externally, e.g., in a portable computer during the installation or servicing of an inventive ITM roller, or it can be processed in any other suitable data processor. The indicia can be read optically, magnetically, or by means of a radio frequency. In addition to a bar code 93, the indicia could include any suitable markings, including symbols and ordinary words, and can be color coded. The indicia could also be read visually or interpreted by eye. A color coded indicia on a roller could exist within a relatively large colored area which can be otherwise devoid of markings or other features making it readily interpreted by the eye to have a property as indicated by the color-coded roller. The indicia can be utilized to measure the wear rate of an inventive ITM roller, e.g., by providing a portion of the indicia having a predetermined wear rate. The wear rate of an indicia can be measured optically, e.g., by monitoring the reflection optical density of a portion of the indicia which is subjected to wear, or by other suitable means. Suitable materials for the indicia are for example inks, paints, magnetic materials, reflective materials, and the like, which are applied directly to the surface of the roller. Alternatively, the indicia can be located on a label that is adhered to the outer surface of the roller. The indicia could also be in raised form or produced by stamping with a die or by otherwise deforming a small local area on the outer surface of the roller, and the deformations can be sensed mechanically or otherwise detected or read using an indicia detector 95 in the form of a contacting probe or by other mechanical means.

Different types of information can be encoded or recorded in the indicia. For example, the outside diameter of a roller can be recorded so that nip width parameters can be accordingly adjusted. The date of manufacture of the roller can be recorded in the indicia for diagnostic purposes, so that the end of useful life of the roller could be estimated for timely replacement. Specific information for each given roller regarding the roller runout, e.g., as measured after manufacture, could also be recorded in the indicia.

When the outside diameter of an inventive roller (or of a sleeve member) is recorded in the indicia, the information can be used to speed the calibration time of a registration system as explained below. For example, the registration system might utilize a software algorithm that controls the speed of the start-of-line clock signal fed to an LED writehead. A separate start-of-line clock signal is used for each color module, each controlling the length of the color toner image of the respective color separation image produced by each module, thereby ensuring that the color toner image length is correct and uniform throughout the image. It is known that, in general, a change in the engagement between a primary imaging roller and an ITM roller changes the speed ratio, thereby altering the length of the image, e.g., by stretching or compressing it as the engagement is increased or decreased. Inventive rollers, and in particular ITM sleeve members, cannot be manufactured practically with identical outside diameters, a typical variation being ±50 micrometers. A small difference in the diameter of a roller will, therefore, effectively change the engagement between the primary imaging and ITM rollers. By utilizing the diameter information of a newly installed roller, the registration unit can immediately correct the start-of-line clock signal so that the image length and uniformity is maintained correctly. This adjustment of the parameters in the algorithm controlling the start-of-line clock signal is one of several parameters that need to be controlled to ensure accurate registration of each digital image written by the writehead. Prior knowledge of the outside diameter given in the bar code speeds the calibration time of the registration system.

It is preferable to transfer a toner image from a PC to an ITM by providing a suitable electric field for electrostatic transfer. This is most readily accomplished by electrically biasing the ITM and grounding a conductive layer situated under a photoconductive layer (or layers) on a PC, as is well known. Electrostatic transfer of the toner image from ITM to a receiver is most readily accomplished by applying a suitable electrical bias to a transfer roller so as to urge the toner to move from ITM to receiver. Another method of providing a suitable electric field for electrostatic transfer of toner from an ITM to a receiver is to apply a corona charge, of polarity opposite to that of the toner, to the rear surface of a receiver sheet as is well known in the art, whereby the need to bias the backup roller is obviated.

Another embodiment employing ITMs of the invention in an electrophotographic press is indicated by 30 in FIG. 1(*b*), which includes a large electrically biased transfer roller 31, which could also be a drum. Four individual color modules are arranged in tandem around transfer roller 31, each module having a PC drum or roller and an ITM drum or roller provided with an elastically deformable surface structure having an effective or operational Poisson's ratio between 0.2 and 0.4, preferably between 0.25 and 0.35. A first module, labeled M1, includes a photoconductive drum 33 labeled PC1 and an intermediate transfer member 32 labeled ITM1. The PCs and ITMs of the other modules are similarly appropriately labeled. A single color toner image, e.g., cyan, is formed in module M1 and is transferred to a receiver sheet 34, labeled R1, when R1 passes through transfer nip 35 after being transported from a supply unit (not shown). As the transfer drum 31 rotates in the direction of the indicated arrow, color separation toner images are successively transferred, on top of each other and in registry, from each ITM to a receiver sheet in modules M2, M3 and M4. When a first toner color separation image is being transferred in module M1 to receiver R1, other color separation toner images are being transferred to receivers R2, R3 and R4, while receiver R5 which carries a composite full color image is on its way to a fuser in a fusing station (not shown). More or fewer than four modules can be used. This type of electrophotographic press is less preferred, because the paper path is not straight and also because the orientations of the development stations with respect to the vertical pull of gravity cannot be the same, requiring costly and significant adaptations of the individual development stations.

FIG. 1(*c*) shows yet another embodiment of a multimodular electrophotographic press, shown as having four modules and indicated by 40, that can utilize ITMs of the invention. More or fewer than four modules can be used. A large inventive ITM 41 rotates clockwise in the direction of the arrow past a series of modules M1, M2, M3, and M4 each including a corresponding photoconductor PC1, PC2, PC3, and PC4 rotating counterclockwise. The ITM 41 is a drum or roller and includes an elastically deformable surface structure having an effective or operational Poisson's ratio between 0.2 and 0.4, preferably between 0.25 and 0.35. A first color separation toner image, e.g., cyan, is formed on roller or drum 42 labeled PC1, and is transferred in nip 45 from PC1 to ITM 41. A second color separation toner image, e.g., magenta, is formed on PC2 and transferred in M2 from PC2 on top of and in registry with the cyan toner image on ITM 41, and so forth until a complete composite full-color image has been built up on ITM 41. The full-color image is subsequently electrostatically transferred in nip 46 to a receiver sheet 44 transported from a supply unit (not shown), using electrically biased transfer backup roller 43. Although this type of electrophotographic press is simpler and gives easier registration than press 30 in FIG. 1(*b*), it is less preferred for similar reasons, as well as for the additional reason that good image quality is more difficult to attain when a 4-color toner stack has to be created without disruptions and then co-transferred intact to a receiver.

A drawback common to the illustrated engines 20, 30, and 40 and other like apparatus, i.e., the need for good control of overdrive in transfer nips involving an ITM, is overcome by the present invention. Prior art compliant ITMs, such as disclosed in U.S. Pat. Nos. 5,084,735; 5,110,702; 5,187,526; 5,666,193; and 5,689,787, do not have good inherent capability in this respect, and as a result, are subject to creating image defects caused by mechanically induced disturbances of a toner image during transfer. These disturbances are the direct outcome of strain buildups and releases due to peripheral speed mismatches resulting from overdrive, especially in apparatus in which PC drums and ITM drums are driven by gears, or in which receivers are driven through transfer nips at constant speed. By reducing the propensity for overdrive, the present inventive rollers provide a substantial improvement in electrophotographic color image quality.

Figure 2A:
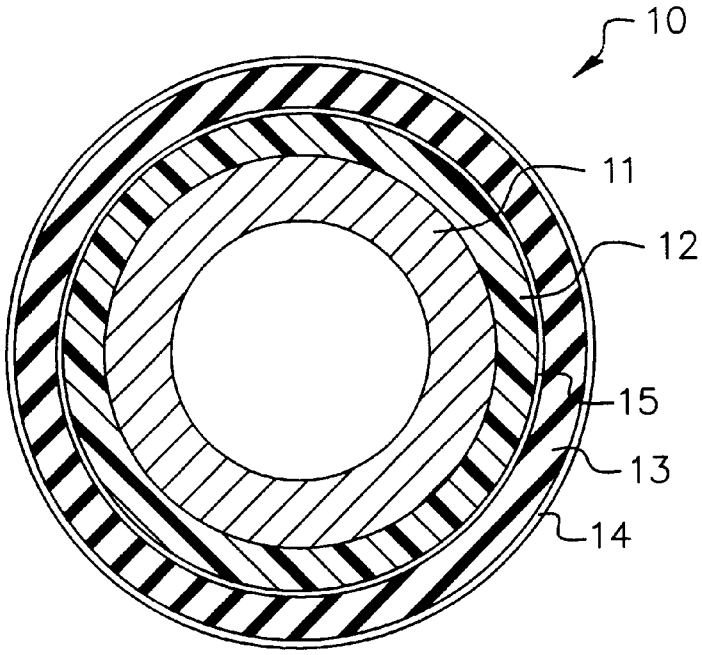
FIG. 2(*a*) is a schematic cross sectional view, not to scale, of a first embodiment of an inventive roller having a conformable layer surrounded by a compliant blanket layer.
Figure 2B:
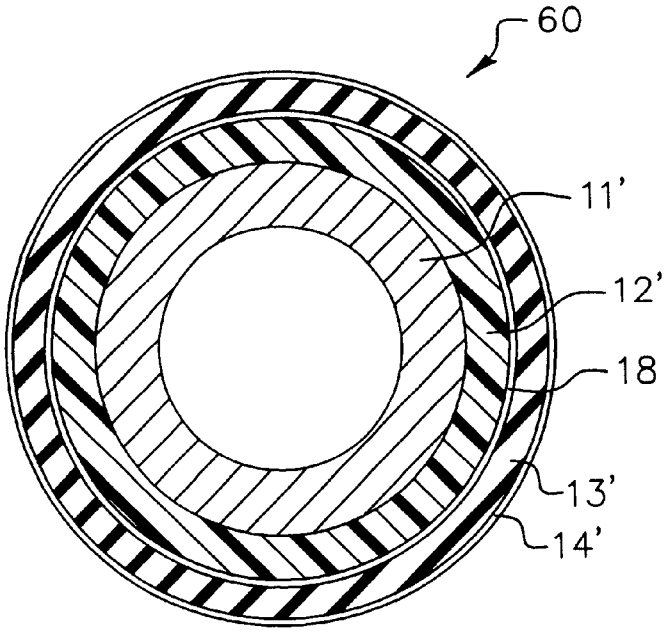

A cross-sectional view of a preferred first embodiment of an elastically deformable ITM roller of the invention is indicated as 10 in FIG. 2(*a*). ITM 10 includes a rigid core member 11, a conformable layer 12 surrounding core member 11, an optional thin, flexible conductive electrode layer 15 adhered to conformable layer 12, an elastomeric compliant blanket layer 13 surrounding and adhered to the electrode layer 15 (or adhered to the conformable layer 12 if layer 15 is absent), and a thin hard outer layer 14 formed on the elastomeric compliant layer 13. It should be understood that layer thicknesses are not drawn to scale but for illustrative purposes. Core member 11 preferably includes a metal such as, for example, aluminum or other suitable metal, in the form of a pipe, which can include internal strengthening members such as struts and the like. Core 11 is cylindrical and centered on its axis of rotation, meaning it preferably has a runout of less than 80 micrometers, and more preferably less than 20 micrometers. The conformable layer 12 preferably includes a closed cell elastomeric foamed material, although an open cell elastomeric foam or sponge can be useful in some applications. The foam or sponge layer 12 can furthermore have a "felted" material. The thickness of the conformable layer 12 is preferably between 3 mm and 25 mm, and more preferably, between 5 mm and 10 mm.

In a modification of the preferred first embodiment of FIG. 2(*a*) which includes the optional conductive layer 15, the layer 15 is preferably connected to a source of voltage or current in order to apply an electric field to effect electrostatic transfer of a toner image to or from ITM 10.

In another embodiment, the optional conductive layer 15 is not included, and the core member 11 includes an electrically conductive surface which is connected to a source of voltage or current. The conformable layer 12 is preferably provided with a suitable conductivity which, for example, can be obtained by dispersing finely divided carbon or other conductive particles within the continuous phase, or by using suitable antistatic materials dissolved in the continuous phase. In this embodiment, the electrical resistivity of the conformable layer 12 is preferably less than $10^8$ ohm-cm and more preferably less than $10^7$ ohm-cm.

Even when the conformable layer 12 is suitably conductive, it can be preferable to include a conductive layer 15 which is electrically floated, thereby providing an equipotential and hence guaranteeing a highly uniform electric field inside compliant blanket layer 13.

The conformable layer 12 preferably includes a polyurethane, a silicone resin, a polyimide, or any other suitable elastomer, and can for example include a copolymer or a polymer blend. Layer 12 can also include a particulate filler or other addenda to modify the electrical or mechanical properties, as is well known. Layer 12 should preferably have uniform thickness, and can be smoothed, e.g., by freezing and grinding, or by other suitable means, prior to application of layers 15 and 13 by suitable methods, e.g., coating. A foam or sponge layer can be wrapped around a core 11 to form conformable layer 12, but wrapping is not the most preferred embodiment because it presents a problem of attaining a smooth joint. Alternatively, conformable layer 12 can be formed by a chemically foamed material from suitable monomers on to core 11 in a cylindrical mold and then cured, or it can be made and located on core 11 by any other suitable methods or means. For example, a mold having two concentric cylinders can be used to make the compliant elastomeric layer 13 in the form of a tube, after which the inner cylinder is demolded, a conductive layer 15 is optionally applied to the interior surface of the tube, a core 11 is inserted with its axis coincident with the axis of the outer cylinder, and a foam layer 12 is made in the space between the core and the inner surface of layer 13 by chemical foaming from suitable monomers and curing, after which the outer cylinder of the mold is demolded. The solid phase of foam layer 12 preferably has a Young's Modulus in a range $1\times10^6$ Pa to $2\times10^9$ Pa, and more preferably, $2\times10^6$ Pa to $5\times10^8$ Pa.

It will be evident that the effective Young's modulus of an elastically deformable foam is usually much less than that of its solid phase, on account of the presence of the gaseous phase. A typical foam or sponge can have a Young's modulus which is an order of magnitude smaller than that of the solid phase. Young's modulus of a foam (or of any material, including a laminated or layered material) is determined on a macroscopic-size sample using a standard technique, such as by measuring the strain of the sample along a given direction under an applied stress using a suitable commercial device such as an Instron Tensile Tester and extrapolating the slope of the curve back to zero applied stress. Poisson's ratio of a foam can be readily measured in a macroscopic-size piece by applying a compressive stress along one direction of a bar shaped sample of the foam, e.g., the z-axis in a Cartesian coordinate system, measuring a corresponding transverse strain parallel to the x-axis (or y-axis), and dividing the x-axis strain by the z-axis strain. In an isotropic foam or sponge material, the x- and y-strains will be identical, but for felted foams, for example, this will generally not be the case. Moreover, an operational or effective value of Poisson's ratio of a compound roller having different layers, one of which is a foam, can also be readily measured using the same technique.

The compliant blanket layer 13 can be applied to the conformable layer 12 or the outer conductive surface of core 11 (depending on the specific embodiment as detailed above) in the form of a tube. The tube can be a thermally shrink-wrapped tube, although this is not the most preferred embodiment because of limitations on materials, thermal shrink wrapping is clearly envisioned within the confines of the present invention. Alternatively, compliant blanket layer 13 can be an elastomeric skin layer produced as a result of foaming in creating conformable layer 12 on to core 11 in a cylindrical mold, but this is also generally less preferred because it is generally desirable to make the conformable layer 12 and the compliant blanket layer 13 from different materials. On the other hand, an elastomeric layer can be coated directly on the skin of compliant blanket layer 13. Compliant blanket layer 13 can be made, for example, by either a solvent coating it or a dip coating it on top of the conformable layer 12, or by any other suitable method or means. A thin subbing or barrier layer can be required between conformable layer 12 and compliant blanket layer 13 [not shown in FIG. 2(*a*)] in order to facilitate coating of compliant blanket layer 13. The compliant layer 13 preferably has thickness in a range of 0.5 mm to 5 mm, preferably 1 mm to 2 mm. Compliant blanket layer 13 has an electrical resistivity which is typically one or more orders of magnitude higher than the resistivity of the conformable layer 12. The electrical resistivity of compliant blanket layer 13 is in a range of $10^7$ ohm-cm to $10^{11}$ ohm-cm, preferably $10^8$ ohm-m to $10^9$ ohm-cm. Compliant blanket layer 13 can include a particulate filler or an antistat to modify the mechanical or electrical properties, as is well known. The compliant blanket layer 13, inclusive of any addenda such as for example antistats or other addenda, has a Young's modulus in a range 0.5 MPa to 50 MPa, preferably 1 MPa to 10 MPa. The compliant blanket layer 13 preferably includes a polyurethane material, but it could also be made from any suitable elastomer.

The outer layer 14 in FIG. 2(*a*) is thin and relatively hard, one purpose of which is to effectively prevent toner embodiment, thereby enhancing electrostatic transfer of toner particles to a receiver. Another purpose is to render the roller 10 more readily cleanable and less abradable in a cleaning station. It is preferable that outer layer 14 be relatively thin, 0.1 micrometer to 20 micrometers thick, having a material whose Young's modulus is greater than 50 MPa and preferably greater than 100 MPa. Layer 14 preferably has a high resistivity, at least as high as that of compliant blanket layer 13. Outer layer 14 can include a continuous layer. Alternatively, the layer can be fractured or be formed of small particles, as is known in the art.

Referring again to FIG. 2(*a*), the thin, flexible, electrode like conductive layer 15 (resistivity less than about $10^7$ ohm-cm) is optionally sandwiched between the conformable layer 12 and the compliant blanket layer 13. Any suitable preferably flexible conductive material can be used. Conductive layer 15 is preferably a conductive elastomer, or it can be an elastomeric material filled with a finely divided conductive material such as carbon powder, or doped with an antistat material. Alternatively, conductive layer 15 can have a thin metallic layer made for example by vacuum evaporation.

The ITM of FIG. 2(*a*) has a conformable layer 12 with a relatively low Poisson's ratio in conjunction with a compliant blanket layer 13 having a relatively high Poisson's ratio. The combination of layers results in mechanical effects that tend to oppose one another, and hence can result in very small values of net overdrive produced by the ITM, these net values can approach and include zero. Thehe Poisson's ratio of the conformable layer 12 (measured with the stress applied in the radial direction) preferably has a value less than 0.4, and more preferably, between 0.20 and 0.35. The Poisson's ratio of the compliant blanket layer 13 preferably has a value between 0.4 and 0.5, and more preferably, between 0.45 and 0.50.

When two separated parallel rollers are pressed together to form a nip, with one or both rollers elastically deformable, the engagement is defined as the sum of the nominal radii of the rollers prior to contact minus the distance separating their respective axes after the nip has been formed.

Distortion in a pressure nip produced by pressing an elastomeric roller against another roller (or against other surface) results in a tangential strain within the nonslip area of contact between the rollers. For example, a roller made from a typical solid elastomer which is substantially incompressible (high Poisson's ratio) will have a tangential tensile strain and its surface stretched in the nip zone, resulting in overdrive of another hard roller which is frictionally driven by it. On the other hand, a roller made from a typical elastomeric foam (low Poisson's ratio) will have a compressive tangential strain in the nip zone, resulting in underdrive of another hard roller which is frictionally driven by it. In the present case, neglecting any small influences of the thin hard outer layer 14 or of the thin electrode layer 15, and inasmuch as conformable layer 12 preferably includes a compressible foam or sponge that typically has a much smaller Poisson's ratio than that of layer 13, the overall distortion of the roller will be very much smaller than if the entire roller were made, say, of a single material having Poisson's ratio similar to that of the compliant blanket 13, which is typically substantially incompressible and has a Poisson's ratio in a range between 0.48 and 0.50.

The roller 10 can include a replaceable removable sleeve member. The sleeve member includes a supporting or strengthening band (not shown) which is in intimate non-adhesive contact and snugly surrounds core member 11, with the conformable layer uniformly adhered to the strengthening band. The other layers 12, 13, 14, and 15 of the roller are as described above. The sleeve can be mounted on, or removed from, the core 11 by means of a compressed air technique, such as described, for example, in U.S. Pat. Nos. 4,903,597; 5,415,961; and 5,669,045. The sleeve could also be mounted or removed by cooling the core member to shrink it (or warming the sleeve to expand it) and sliding the sleeve along the core member. The strengthening band can be rigid, but is preferred to be flexible. The strengthening band preferably has a Young's modulus in a range of 100–300 GPa, and a thickness preferably in a range of 20 micrometers–500 micrometers, more preferably 40 micrometers–100 micrometers. The strengthening band, which can be fabricated from a sheet, for example by ultrasonic welding or by an adhesive, could be included of any suitable material, including metal, elastomer, plastic or a reinforced material such as, for example, a reinforced silicone belt. It is preferred that the strengthening band be in the form of a seamless web or tube including nickel or steel.

It is preferred to provide an indicia on an outer surface near an end of roller 10, e.g., on the outer surface of outer layer 14. The placement of the indicia and its properties and methods of detection are entirely similar to those of roller 90 described above.

FIG. 2(*b*) shows a cross-sectional view of a preferred second embodiment of the invention, generally referred to as 60. The primed entities 11', 12', 13' and 14' correspond in all respects of dimensions, materials and physical properties to the unprimed entities having the same reference designation previously discussed for FIG. 2(*a*) namely: core member 11; conformable layer 12; compliant blanket layer 13; and thin hard outer layer 14, respectively. ITM roller 60 includes a core member 11', a base cushion layer 12' formed on the core member 11', a stiffening layer 18 surrounding and in intimate contact with the base cushion layer, a compliant blanket layer 13' formed on the stiffening layer, and a flexible thin hard outer layer 14' formed on the stiffening layer. The stiffening layer 18 can also function as an electrically biasable electrode layer when connected to a source of voltage or current. The stiffening layer 18 is preferably electrically conductive, thin, and flexible, and has the form of a tubular belt. Stiffening layer 18 is preferably seamless and can employ any suitable material, including conductive polymers and reinforcing members such as fibers or woven materials. Preferably, stiffening layer 18 is a thin metallic band including any suitably strong metal including plated metals, such as for example nickel or stainless steel. Stiffening layer 18 has a thickness less than 500 micrometers, preferably in a range of 10–200 micrometers, and a Young's modulus greater than 0.1 GPa, preferably in a range of 50–300 GPa. The preferred material for stiffening layer 18 is nickel in the form of an electroformed belt available, e.g., from Stork Screens America, Inc., is of Charlotte, N.C. The roller 60 can be manufactured by forming the base cushion layer on the core member, e.g., in a mold, and then cooling the core plus base cushion layer in order to shrink it, e.g., by using dry ice, followed by sliding the stiffening layer, e.g., in the form of a seamless metallic belt, on to the base cushion layer. After warming, e.g., to room temperature, the compliant blanket layer is formed on the stiffening layer, e.g., by solvent coating and curing, followed by applying the hard outer layer.

The roller 60 could also employ a replaceable removable sleeve member. The sleeve member includes a supporting or strengthening band (not shown) which is in intimate non-adhesive contact and snugly surrounds core member 11', with the conformable layer uniformly adhered to the strengthening band. The other layers 12', 13', 14', and 18 of the roller are as described above. The sleeve can be mounted on, or removed from, the core 11' by means of a compressed air technique, such as described, for example, in U.S. Pat. Nos. 4,903,597; 5,415,961; and 5,669,045. The sleeve could also be mounted or removed by cooling the core member to shrink it (or warming the sleeve to expand it) and sliding the sleeve along the core member. The strengthening band can be rigid, but is preferred to be flexible. The strengthening band preferably has a Young's modulus in a range of 100–300 GPa, and a thickness preferably in a range of 20 micrometers–500 micrometers, more preferably 40 micrometers–100 micrometers. The strengthening band, which can be fabricated from a sheet, for example by ultrasonic welding or by an adhesive, can be formed of any suitable material, including metal, elastomer, plastic or a reinforced material such as, for example, a reinforced silicone belt. It is preferred that the strengthening band be in the form of a seamless web or tube having nickel or steel.

It is preferred to provide an indicia on an outer surface near an end of roller 60, e.g., on the outer surface of layer 14'. The placement of the indicia and its properties and methods of detection are entirely similar to those of roller 90 described above.

Computations in two dimensions to illustrate the invention have been carried out using a computer and a finite element method of analysis. In the computational Examples below, a compound roller 10 of the invention is considered rolling in frictional contact with a nondeformable (rigid) planar surface. The numerical results obtained apply directly to similar configurations, such as depicted in FIG. 1(*a*) which shows transfer of toner images from ITMs to receiver sheets (e.g., having high modulus paper) carried on a relatively nondeformable transport belt using a backup roller. On the other hand, the first transfers of toner take place from drum PC members to ITMs, i.e., in configurations close to that of rigid roller/compliant roller. All the benefits of the ITM of the invention that apply to a second transfer of toner from an ITM to a receiver apply also to a first transfer from a drum PC to a drum ITM. Calculations similar to those reported in the examples could be performed for the rigid roller/compliant roller format, and generally similar findings, e.g., optimal values of Poisson's ratio for conformal layer 12, would be obtained, although nip widths would be smaller for the same engagement and, for a given roller, the tangential strains would be larger. The calculations in the Examples are for a simplified ITM drum having a rigid core, a conformable foam or sponge layer in intimate contact with the core, and an outer elastomeric compliant blanket layer in intimate contact with the conformable layer. Thin layers, such as layers 14 and 15 in FIG. 2(*a*), have been omitted. The model geometry has the above simplified drum pressed against a rigid planar element with a force that produces a suitable nip width or engagement (where the engagement is the nominal radius of the roller far from the nip minus the distance from the roller axis to the center of the nip). The ITM rotates and frictionally drives the planar element which moves frictionlessly across a supporting platen.

In all the calculations the coefficient of friction is chosen to be 0.5. It should be noted that, inasmuch as the tangential strain in the flat portion of non-slip contact (lockdown region) between roller and the rigid planar element determines the amount of overdrive, the coefficient of friction would seem to be irrelevant except to define a maximum drag force associated with moving the planar element. However, just before the nip entrance and exit, some slippage tends to occur over very short distances compared to the nip width, and there is a weak effect on the geometry caused by this slippage which in turn depends on the assumed value of the coefficient of friction in the calculations. The results are not sensitive to the choice of the coefficient of friction, and hence the value of 0.5 was chosen as representative of real systems.

Calculations were performed on a 300 MHz, 128 MB computer system using an ANSYS finite element modeling package. The desired end point for each set of input values was the calculated speed ratio, i.e., the speed of the moving planar element, divided by the peripheral or tangential speed of the undistorted roller far away from the nip. To start a calculation, the engagement was initially set at 0.001" without rolling so as to produce sufficient friction to suppress slippage in what is known as Load Step 1. Motion of the roller, with corresponding translational motion of the rigid planar element, was commenced at 11.7 inches per second for a total of 15 degrees of roller rotation in 10 sub-steps, during which the engagement was shifted to specific value and the drag forces assumed for the particular calculation were ramped to their full value. This process, known as Load Step 2, was used to establish the zero of the computational conditions for the remainder of the numerical iterations. Computational conditions were kept constant during the next 10 degrees of rotation in ten 1° sub-steps known as Load Step 3, and for the next 10 degrees of rotation in one hundred 0.1° sub-steps known as Load Step 4. Speed ratios representing the computed overdrive are the average speed ratios in Load Step 4. It was usual for the average speed ratio at the end of Load Step 3 to be consistent with the values obtained during Load Step 4, assuring that the computations represented a steady state result.

In Examples 1–4 below, the thickness of the conformable layer is 5 mm and the thickness of the elastomeric compliant blanket layer is 1 mm. The core diameter is 169.6 mm. The Poisson's ratio $\nu_1$ of the compliant blanket layer 13 was set at 0.490 throughout. The Young's moduli $E_1$ and $E_2$ of the compliant blanket 13 and conformable layers 12, respectively, the Poisson's ratio $\nu_2$ of the conformable layer 12, as well as the engagement and drag applied to the planar rigid element, are variables in the calculation which are systematically altered. In the finite element modeling, the mesh was chosen to be approximately equiaxed in the neighborhood of the contact. Outside the contact zone, the mesh was progressively coarsened. To include any relevant hoop stress effects, the system was modeled in its entirety, albeit with coarser meshes far from the contact zone. The simulated rolling of the mesh was selected so that good quality, equiaxed mesh was engaged during the data collection phase of the computation. Eight node quadratic elements were used throughout the roller while four node quadratic elements were used in the planar element. Contact elements were used to dynamically establish the regions of engagement. Both LaGrange and penalty methods were used to control contact elements with similar computational results. Shear friction in the contact zone employed the use of penalty functions with appropriate stiffnesses. The overall results were found insensitive to the details of the modeling.

EXAMPLE 1

Effect of the Poisson's Ratio of the Conformable Layer

Figure 3:
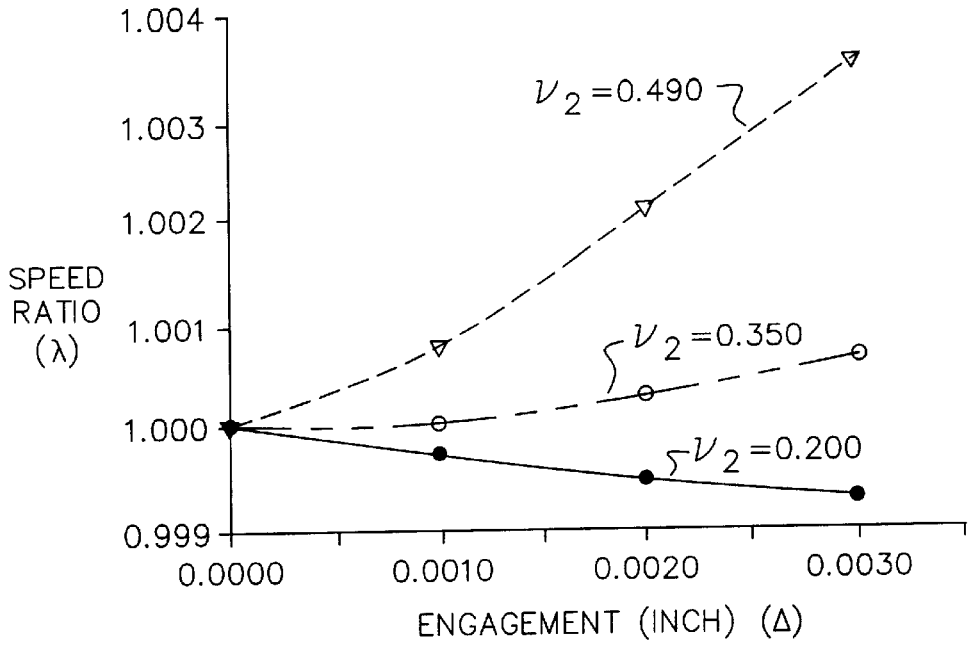
FIG. 3 shows computed plots of speed ratio as a function of engagement, with zero drag, for different values of Poisson's ratio of the conformable layer of a roller according to the invention, the roller having a conformable layer covered by a compliant blanket layer.

The speed ratio, $\lambda$, i.e., the speed of the moving planar element, divided by the peripheral or tangential speed of the undistorted roller far away from the nip, is calculated as a function of engagement for three different assumed values of $\nu_2$, the Poisson's ratio of the inner, conformable layer. The drag force applied to the rigid planar element is zero, the Young's moduli $E_1$ and $E_2$ of the compliant blanket and conformable layer are both equal to 0.5 kilopounds per square inch (ksi), or 3.45 MPa. Calculated theoretical results after Load Step 4 are shown in FIG. 3. The uppermost curve, for which $\nu_2$=0.490, represents the case of a roller in which the inner, conformable layer and the compliant layer have the same mechanical properties, i.e., as if the entire coating of the core member were made of a typical, substantially incompressible, elastomer. All the computed values for this curve are greater than unity, i.e., the planar element is overdriven for all engagements, and the amount of overdrive has a strong dependency upon engagement. For $\nu_2$=0.350, a small amount of overdrive is also observed for all engagements, but the amount of overdrive in excess of unity is reduced by a factor of about 7 compared to that of a solid elastomeric roller at an engagement $\Delta$=0.0030". The slope of the computed curve for $\nu_2$=0.350 is very small, which is very advantageous because the slope ($d\lambda/d\Delta$) is a measure of differential overdrive. The bottom curve, for $\nu_2$=0.200, exhibits a small amount of underdrive for all engagements shown, and the dependency upon engagement, i.e., the slope ($d\lambda/d\Delta$), is also desirably small. It will be evident that a choice of $\nu_2$ close to about 0.30 will produce negligible sensitivity of the speed ratio to engagement for all engagements up to 0.0030", and by visual inspection of FIG. 3, to much higher engagements. A great practical importance of this is that differential overdrive, which is manifested by fluctuations of engagement caused for example by eccentricity or concentricity variations of the roller, will be minimized for $\nu_2 \approx 0.30$, yet still be small in the range $0.200 \leqq \nu_2 \leqq 0.350$.

EXAMPLE 2

Varying Engagement, Constant Drag Force

Figure 4:
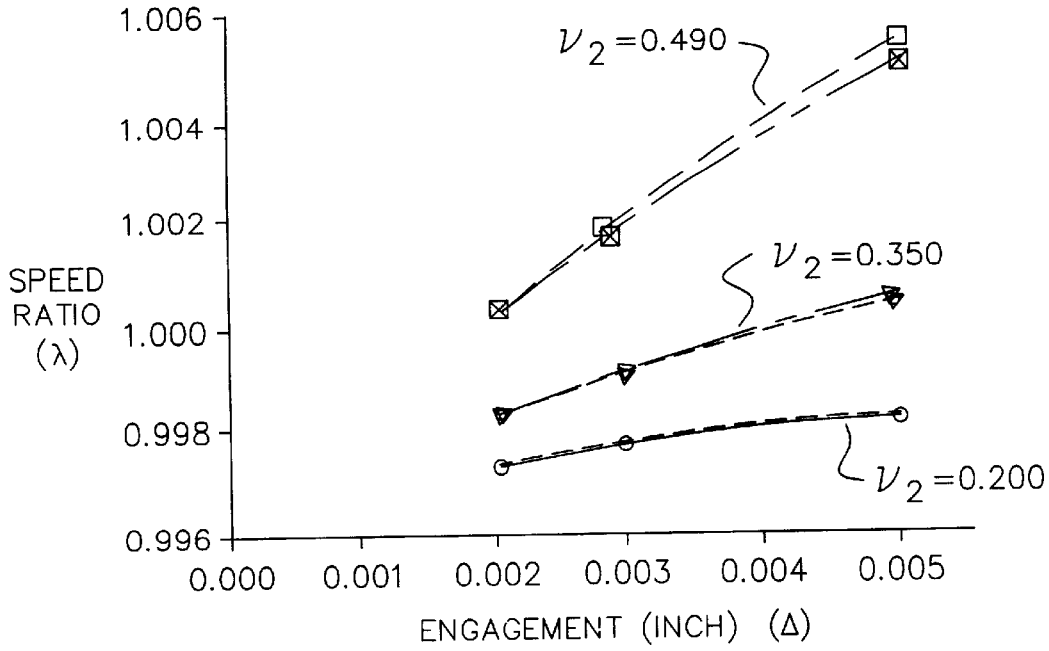
FIG. 4 shows computed plots of speed ratio as a function of engagement, with a nominal positive drag torque, for different values of Poisson's ratio of the conformable layer of a roller according to the invention, the roller having a conformable layer covered by a compliant blanket layer.

The input parameters are the same as for Example 1, except that a drag force is applied to the planar element (positive drag opposes the direction of motion of the planar element, negative drag is in the same direction). The drag force can, of course, be equivalently applied to the roller, and can be expressed as a torque per unit length of the roller. The results of applying a positive drag torque of 7.26 inch-oz per inch roller length are shown in FIG. 4, where speed ratio, $\lambda$ is plotted versus engagement, $\Delta$. The solid points result from ending the calculation at the end of Load Step 3, and the open points after Load Step 4. The downward curvature of the plotted lines for small engagements is a hallmark of impending slippage if the engagement becomes too small. In fact, for the present parameters, slippage does in fact occur for engagements above 0.0010" but below 0.002" (these data not plotted). Comparison with FIG. 3 shows that the drag force has a significant influence on the results. For example, in FIG. 4 for $\nu_2$=0.350 there is underdrive for all engagements up to about 0.0043" and overdrive for larger engagements, while in FIG. 3 with no drag there is overdrive for all engagements. The overall behaviors comparing drag versus no drag are qualitatively similar, in that the sensitivity to engagement ($d\lambda/d\Delta$) is much less for $\nu_2$=0.350 and $\nu_2$=0.200, and it is clear that rollers with these lower values of $\nu_2$ exhibit robust behavior when drag is present, as is inevitably the case for real electrophotographic machines.

EXAMPLE 3

Constant Engagement, Varying Drag Force

Figure 5:
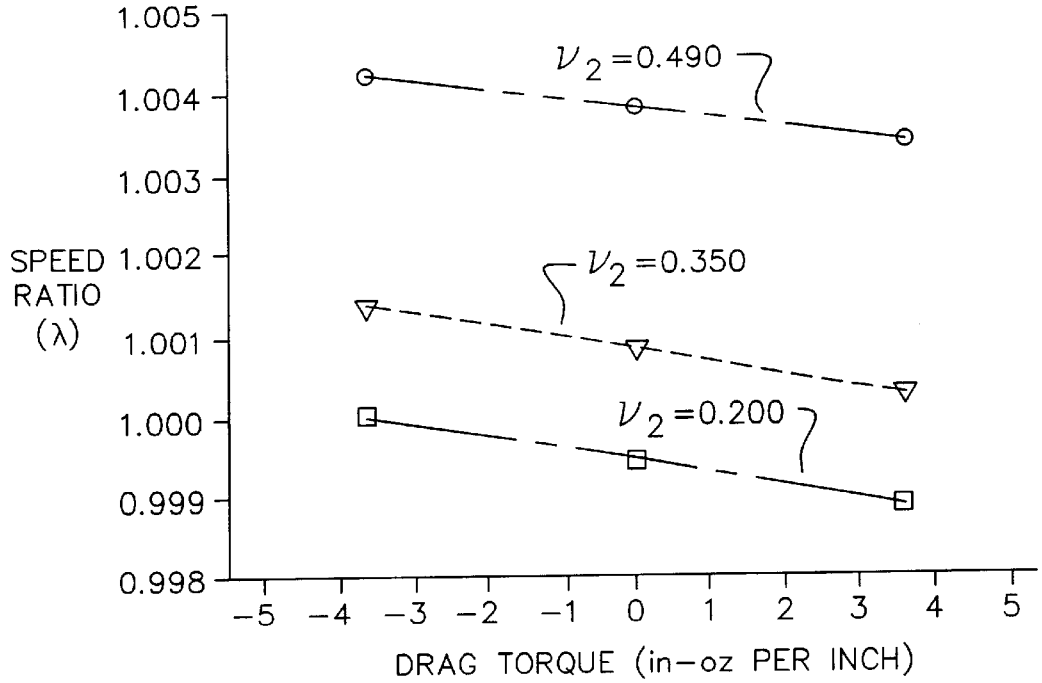
FIG. 5 shows computed plots of speed ratio as a function of drag torque, with a nominal engagement, for different values of Poisson's ratio of the conformable layer of a roller according to the invention, the roller having a conformable layer covered by a compliant blanket layer.

This EXAMPLE further explores speed ratio $\lambda$ as a function of drag torque per unit length of roller for a constant engagement of 0.0030". All other parameters are the same as for Examples 1 and 2. FIG. 5 shows the effects of both positive and negative drag. It can be seen that the sensitivity to drag, i.e., the slopes of the plotted lines, is virtually independent of $\nu_2$. Moreover, when $\nu_2$ is somewhat above 0.200 and less than 0.350, and preferably less than about 0.3, the amounts of overdrive or underdrive are minimized.

EXAMPLE 4

Effect of the Stiffness of the Conformable Layer

Figure 6:
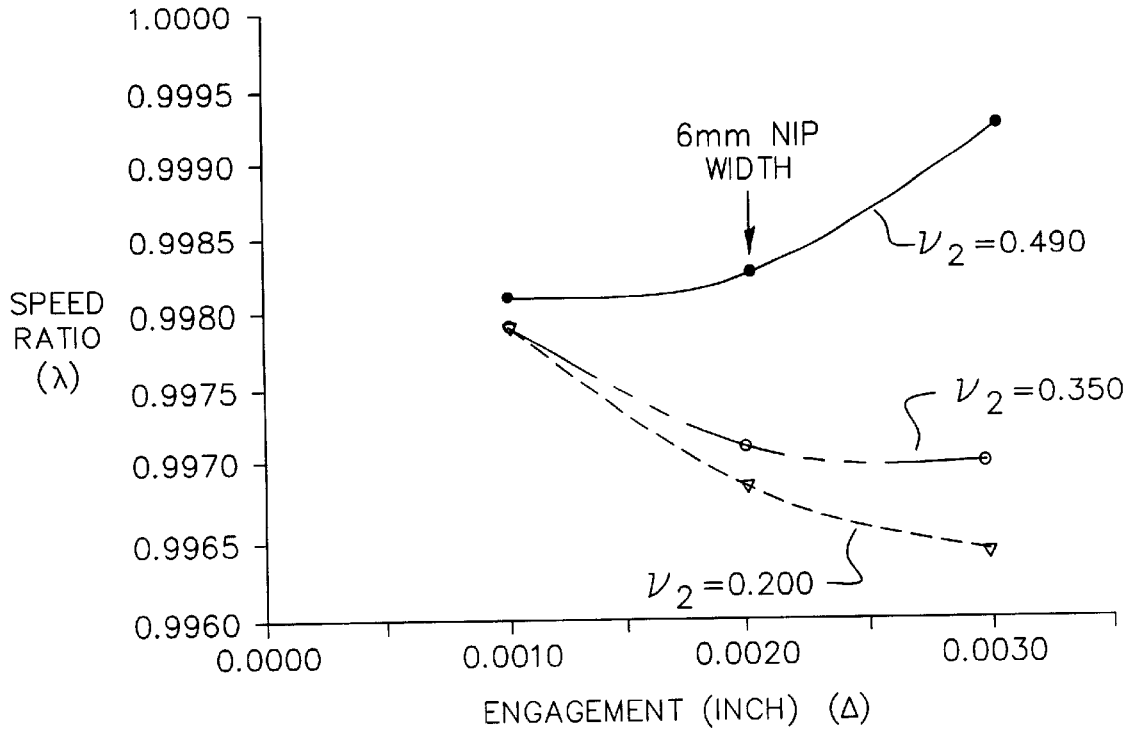
FIG. 6 shows computed plots of speed ratio as a function of engagement, with zero drag, for different values of Poisson's ratio of the conformable layer of a roller according to the invention, the roller having a conformable layer covered by a compliant blanket layer, when the Young's modulus of the conformable layer is one-tenth as large as the modulus of the compliant layer.

The effect of changing the stiffness, i.e., Young's modulus $E_2$ of the inner, conformable layer is illustrated in FIG. 6, where speed ratio, $\lambda$, is plotted versus engagement, $\Delta$. The input data are the same as for Example 1, with zero drag, except that the modulus of the conformable layer is reduced to one-tenth of the modulus $E_1$ of the compliant blanket layer, i.e., $E_2$=0.05 ksi (0.345 MPa) and $E_1$=0.5 ksi. The results are shown following Load Step 4. Softening the conformable layer has a drastic effect. Underdrive is now observed for all the data points. The upper curve of FIG. 6 represents a hypothetical case for which the inner, conformable layer and the compliant blanket layer are both substantially incompressible, but where the inner, conformable layer is tenfold softer. In comparison to the case of a uniform roller which produces overdrive (upper curve in FIG. 3), making the conformable layer much softer produces underdrive, even though $\nu_1$ and $\nu_2$ are the same (0.490) for both curves. Note that for this much softer roller the nip width, indicated by the arrow for an engagement of only two thousandths of an inch, is 6 mm, which is very large. This result clearly demonstrates that Poisson's ratio alone does not determine whether overdrive or underdrive is produced, which can also be concluded from the curves for $\nu_2$=0.350 when comparing FIGS. 3 and 6. For this type of roller having a much softer conformable layer, the greatest insensitivity to engagement, ($d\lambda/d\Delta$), averaged over engagements below 0.003", can be estimated to occur for $\nu_2 \approx 0.43$, rather than $\approx$0.30, as was the case in Example 1. However, for higher engagements which are useful in practical applications, it is clear from FIG. 6 that $\nu_2$ close to about 0.3 is preferred in order to minimize differential overdrive for the higher engagements.

EXAMPLE 5

Figure 7:
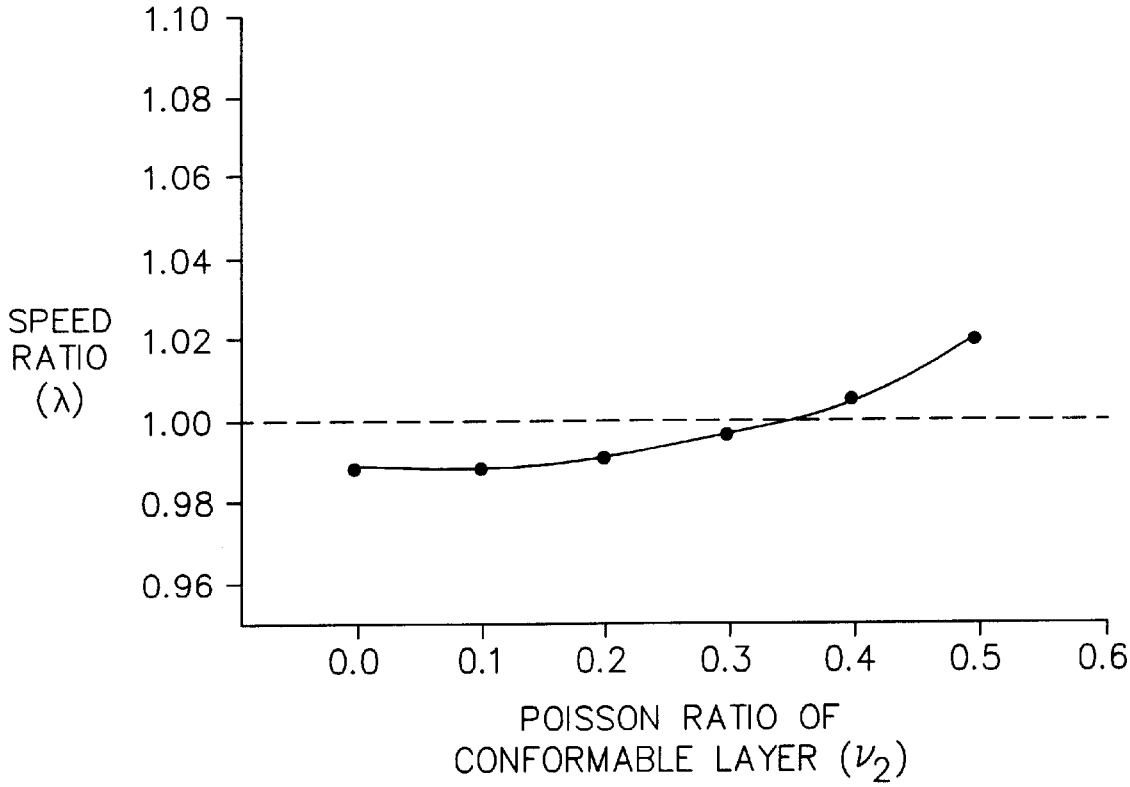
FIG. 7 shows a computed plot of speed ratio as a function of Poisson's ratio of the conformable layer of a roller according to the invention, the roller having a conformable layer covered by a compliant blanket layer.

Soft Conformable Layer, Fixed Engagement: Effect of Poisson's Ratio of Conformable Layer In this EXAMPLE, the thicknesses of the layers are somewhat different from the previous Examples, and the engagement $\Delta$=0.100", which is a considerably larger engagement than previously. The roller outer diameter is the same (181.6 mm) but the compliant blanket layer is now 0.125 inch thick (3.175 mm) and the inner, conformable layer 0.5 inch thick (12.70 mm). The Young's moduli are the same as in Example 4, with the conformable layer having one-tenth the stiffness of the compliant blanket layer. The drag is zero. FIG. 7 shows calculated values of the speed ratio, $\lambda$ as a function of the Poisson's ratio $\nu_2$ of the conformable layer, with the compliant blanket layer having $\nu_1$=0.490 as previously. It can be seen that the speed ratio is unity when $\nu_2$=0.36. Given that the conformable and compliant blanket layer thicknesses are not very dissimilar from the previous Examples, it can be concluded from this result that the roller of FIG. 6 should also produce zero overdrive at a comparably large engagement.

An analysis of the Examples above indicates that Poisson's ratio for the inner, conformable layer is preferably in a range between 0.2 and 0.4, and more preferably between 0.20 and 0.35. The engagement is preferably less than about 15% to 20% of the thickness of the inner, conformable layer.

Figure 8:
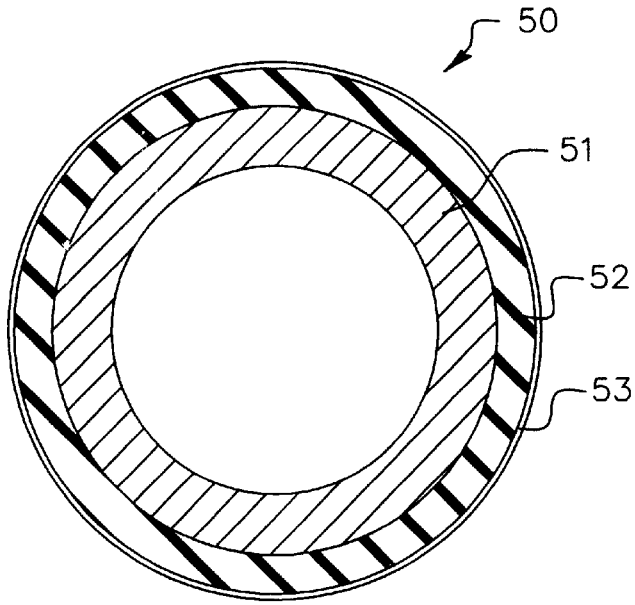
FIG. 8 is a schematic cross sectional view, not to scale, of a third embodiment of an inventive ITM roller having an operational or effective Poisson's ratio between 0.2 and 0.4.

Turning now to FIG. 8, an end-on cross-sectional view indicated by the numeral 50 is shown of a third modification of an inventive roller having an elastically deformable structure. Roller 50 includes a tubular rigid cylindrical core member 51, and an elastically deformable structure 52 adhered to the core. The elastically deformable structure 52 has an effective or operational Poisson's ratio between 0.2 and 0.4, preferably between 0.25 and 0.35, and more preferably between 0.28 and 0.32. Preferably, the deformable structure 52 includes a thin hard flexible outer layer 53.

Core member 51 preferably includes a metal such as, for example, aluminum or other suitable metal, and can include internal strengthening members such as struts and the like.

The hard outer layer 53 has the same dimensions and properties as disclosed above for layer 14 of FIG. 2(*a*).

The elastically deformable structure 52 can include one or more layers. The thickness of structure 52 is not critical, and is typically between 2 mm and 15 mm thick. The operational or effective Young's modulus is typically in a range 0.5 MPa to 50 MPa, preferably 1 MPa to 10 MPa.

In order to tailor or control the mechanical or electrical properties of the elastically deformable structure 52, it can further include one or more of the following: a stiffening layer, a particulate filler, an antistat, a composite material, or a polyphase material including a foam.

The roller 50 can also include a replaceable removable sleeve member. The sleeve member includes a supporting or strengthening band (not shown) which is in intimate non-adhesive contact and snugly surrounds core member 51, with the conformable layer uniformly adhered to the strengthening band. The other layers 52 and 53 of the roller are as described above. The sleeve can be mounted on, or removed from, the core 51 by means of the compressed air technique. The sleeve can also be mounted or removed by cooling the core member to shrink it (or warming the sleeve to expand it) and sliding the sleeve along the core member. The strengthening band can be rigid, but is preferred to be flexible. The strengthening band preferably has a Young's modulus in a range of 100–300 GPa, and a thickness preferably in a range of 20 micrometers–500 micrometers, more preferably 40 micrometers–100 micrometers. The strengthening band, which can be fabricated from a sheet, for example by ultrasonic welding or by an adhesive, can be included of any suitable material, including metal, elastomer, plastic or a reinforced material such as, for example, a reinforced silicone belt. It is preferred that the strengthening band be in the form of a seamless web or tube having nickel or steel.

It is preferred to provide an indicia on an outer surface near an end of roller 50, e.g., on the outer surface of the elastically deformable structure 52. The placement of the indicia and its properties and methods of detection are entirely similar to those of roller 90 described above.

The invention provides apparatus and methods of reducing both overdrive and differential overdrive associated with an intermediate transfer member roller of an electrostatographic color reproduction machine. The primary benefits include an improved registration of color separation toner images, and an improved fidelity of reproduction with minimal distortion of an original or input image to be reproduced.

In accordance with the above, and in the following numbered paragraphs below, it is apparent that the inventors have described:

1A. An intermediate transfer roller for use in electrostatography including:

a rigid cylindrical core member;

a conformable layer surrounding the core member;

an optional thin flexible electrically conductive electrode layer adhered to the conformable layer;

a compliant blanket layer surrounding and adhered to the electrode layer;

a thin hard outer layer formed on the compliant blanket layer;

wherein Poisson's ratio of the conformable layer has a value less than 0.4.

1B. An intermediate transfer roller for use in electrostatography including:

a rigid cylindrical core member;

a conformable layer surrounding the core member;

a stiffening layer surrounding and in intimate contact with the conformable layer;

a compliant blanket layer formed on the stiffening layer;

a thin hard outer layer formed on the compliant blanket layer;

wherein Poisson's ratio of the conformable layer has a value less than 0.4.

2A. The roller according to Paragraph 1A wherein Poisson's ratio of the conformable layer has a value between 0.20 and 0.35.

2B. The roller according to Paragraph 1B wherein Poisson's ratio of the conformable layer has a value between 0.20 and 0.35.

3A. The roller according to Paragraph 1A wherein the conformable layer includes a foam having a solid phase in the form of an open-cell or closed-cell structure.

3B. The roller according to Paragraph 1B wherein the conformable layer includes a foam having a solid phase in the form of an open-cell or closed-cell structure.

4A. The roller according to Paragraph 1A wherein the Poisson's ratio of the compliant blanket layer has a value between 0.4 and 0.5.

4B. The roller according to Paragraph 1B wherein the Poisson's ratio of the compliant blanket layer has a value between 0.4 and 0.5.

5A. The roller according to Paragraph 4A wherein the Poisson's ratio of the compliant blanket layer has a value between 0.45 and 0.50.

5B. The roller according to Paragraph 4B wherein the Poisson's ratio of the compliant blanket layer has a value between 0.45 and 0.50.

5C. The roller according to Paragraph 5A wherein the compliant blanket layer is substantially incompressible and has a Poisson's ratio between 0.48 and 0.50.

5D. The roller according to Paragraph 5C wherein the compliant blanket layer is substantially incompressible and has a Poisson's ratio between 0.48 and 0.50.

6A. The roller according to Paragraph 1A wherein the conformable layer is adhered to the core member.

6B. The roller according to Paragraph 1B wherein the conformable layer is adhered to the core member.

7A. The roller according to Paragraph 1A wherein:

the conformable layer is adhered to a seamless tubular strengthening band which is in intimate nonadhesive contact with the core member; and the strengthening band, the conformable layer, the optional electrode layer, the compliant blanket layer and the thin hard outer layer together create a seamless multilayer tubular replaceable removable sleeve member.

7B. The roller according to Paragraph 1B wherein:

the conformable layer is adhered to a seamless tubular strengthening band which is in intimate nonadhesive contact with the core member; and the strengthening band, the conformable layer, the stiffening layer, the compliant blanket layer and the thin hard outer layer together create a seamless multilayer tubular replaceable removable sleeve member.

8A. The roller according to Paragraph 1A wherein the Young's modulus of the compliant blanket layer is in a range of 0.5 MPa to 50 MPa.

8B. The roller according to Paragraph 1B wherein the Young's modulus of the compliant blanket layer is in a range of 0.5 MPa to 50 MPa.

9A. The roller according to Paragraph 8A wherein the Young's modulus of the compliant blanket layer is in a range of 1 MPa to 10 MPa.

9B. The roller according to Paragraph 8B wherein the Young's modulus of the compliant blanket layer is in a range of 1 MPa to 10 MPa.

10A. The roller according to Paragraph 1A wherein the thickness of the compliant blanket layer is in a range of 0.5 mm to 5 mm.

10B. The roller according to Paragraph 1B wherein the thickness of the compliant blanket layer is in a range of 0.5 mm to 5 mm.

11A. The roller according to Paragraph 10A wherein the thickness of the compliant blanket layer is in a range of 1 mm to 2 mm.

11B. The roller according to Paragraph 10B wherein the thickness of the compliant blanket layer is in a range of 1 mm to 2 mm.

12A. The roller according to Paragraph 1A wherein the electrical resistivity of the compliant blanket layer is in a range of $10^7$ ohm-cm to $10^{11}$ ohm-cm.

12B. The roller according to Paragraph 1B wherein the electrical resistivity of the compliant blanket layer is in a range of $10^7$ ohm-cm to $10^{11}$ ohm-cm.

13A. The roller according to Paragraph 12A wherein the electrical resistivity of the compliant blanket layer is in a range of $10^8$ ohm-cm to $10^9$ ohm-cm.

13B. The roller according to Paragraph 12B wherein the electrical resistivity of the compliant blanket layer is in a range of $10^8$ ohm-cm to $10^9$ ohm-cm.

14A. The roller according to Paragraph 3A wherein the foam is a felted foam.

14B. The roller according to Paragraph 3B wherein the foam is a felted foam.

15A. The roller according to Paragraph 3A wherein the solid phase of the foam has a Young's modulus in a range of $1\times10^6$ Pa to $2\times10^9$ Pa.

15B. The roller according to Paragraph 3B wherein the solid phase of the foam has a Young's modulus in a range of $1\times10^6$ Pa to $2\times10^9$ Pa.

16A. The roller according to Paragraph 15A wherein the solid phase of the foam has a Young's modulus in a range of $2\times10^{6}$ Pa to $5\times10^8$ Pa.

16B. The roller according to Paragraph 15B wherein the solid phase of the foam has a Young's modulus in a range of $2\times10^6$ Pa to $5\times10^8$ Pa.

17A. The roller according to Paragraph 1A wherein the electrical resistivity of the conformable layer is less than $10^8$ ohm-cm.

17B. The roller according to Paragraph 1B wherein the electrical resistivity of the conformable layer is less than $10^8$ ohm-cm.

18A. The roller according to Paragraph 17A wherein the electrical resistivity of the conformable layer is less than $10^7$ ohm-cm.

18B. The roller according to Paragraph 17B wherein the electrical resistivity of the conformable layer is less than $10^7$ ohm-cm.

19A. The roller according to Paragraph 1A wherein the electrical resistivity of the conformable layer is less than the electrical resistivity of the compliant blanket layer.

19B. The roller according to Paragraph 1B wherein the electrical resistivity of the conformable layer is less than the electrical resistivity of the compliant blanket layer.

20A. The roller according to Paragraph 1A wherein the thickness of the conformable layer is between 3 mm and 25 mm.

20B. The roller according to Paragraph 1B wherein the thickness of the conformable layer is between 3 mm and 25 mm.

21A. The roller according to Paragraph 20A wherein the thickness of the conformable layer is between 5 mm and 10 mm.

21B. The roller according to Paragraph 20B wherein the thickness of the conformable layer is between 5 mm and 10 mm.

22A. The roller according to Paragraph 1A wherein the optional electrode layer is connected to a source of current or voltage.

22B. The roller according to Paragraph 1B wherein the stiffening layer is connected to a source of current or voltage.

23A. The roller according to Paragraph 1A wherein the thin hard outer layer has a Young's modulus greater than 50 MPa, a thickness between 0.1 micrometer and 20 micrometers, and a resistivity at least as high as the resistivity of the compliant blanket layer.

23B. The roller according to Paragraph 1B wherein the thin hard outer layer has a Young's modulus greater than 50 MPa, a thickness between 0.1 micrometer and 20 micrometers, and a resistivity at least as high as the resistivity of the compliant blanket layer.

24A. The roller according to Paragraph 1A wherein the Young's modulus of the conformable layer is of the same order of magnitude as the Young's modulus of the compliant blanket layer.

24B. The roller according to Paragraph 1B wherein the Young's modulus of the conformable layer is of the same order of magnitude as the Young's modulus of the compliant blanket layer.

25. An intermediate transfer roller for use in electrostatography including:

a rigid cylindrical core member;

an elastically deformable structure including one or more layers surrounding the core member;

wherein the said an elastically deformable structure has an operational or effective Poisson's ratio in a range of 0.2 to 0.4.

26. A roller according to Paragraph 25 wherein the said an elastically deformable structure has an operational or effective Poisson's ratio in a range of 0.25 to 0.35.

27. The roller according to Paragraph 26 wherein said an elastically deformable structure has an operational or effective Poisson's ratio in a range of 0.28 to 0.32.

28A. A roller according to Paragraph 25 wherein:

the said an elastically deformable structure is adhered to a seamless tubular strengthening band which is in intimate nonadhesive contact with the core member; and the strengthening band and the said an elastically deformable together form a seamless multilayer tubular replaceable removable sleeve member.

28B. A roller according to Paragraph 28A wherein the said elastically deformable structure includes a thin hard layer formed on the elastically deformable structure.

29A. The roller according to Paragraph 1A wherein the thin hard outer layer has a Young's modulus greater than 50 MPa.

29B. The roller according to Paragraph 1B wherein the thin hard outer layer has a Young's modulus greater than 50 MPa.

29C. The roller according to Paragraph 28B wherein the thin hard outer layer has a Young's modulus greater than 50 MPa.

30A. The roller according to Paragraph 29A wherein the thin hard outer layer has a Young's modulus greater than 100 MPa.

30B. The roller according to Paragraph 29B wherein the thin hard outer layer has a Young's modulus greater than 100 MPa.

30C. The roller according to Paragraph 29C wherein the thin hard outer layer has a Young's modulus greater than 100 MPa.

31A. The roller according to Paragraph 1A wherein the thin hard outer layer has a thickness between 0.1 micrometer and 20 micrometers.

31B. The roller according to Paragraph 1B wherein the thin hard outer layer has a thickness between 0.1 micrometer and 20 micrometers.

31C. The roller according to Paragraph 28B wherein the thin hard outer layer has a thickness between 0.1 micrometer and 20 micrometers.

32A. The roller according to Paragraph 7A wherein the strengthening band includes nickel or steel.

32B. The roller according to Paragraph 7B wherein the strengthening band includes nickel or steel.

32C. The roller according to Paragraph 28A wherein the strengthening band includes nickel or steel.

33A. A reproduction method including:

providing one or more electrostatographic modules, each module including a rotating primary image forming member (PIFM) drum or roller;

providing in each module a counter-rotating intermediate transfer member (ITM) drum or roller including: a rigid cylindrical core member, a conformable layer surrounding the core member, an optional thin flexible electrically conductive electrode layer adhered to the conformable layer, a compliant blanket layer surrounding and adhered to the electrode layer, and a thin hard outer layer coated on the blanket layer, wherein the Poisson's ratio of the conformable layer has a value less than or equal to 0.4;

forming a first pressure transfer nip between each said a rotating primary image forming member and each said a counter-rotating intermediate transfer member;

forming a single color toner image on each primary image forming member;

providing an electric transfer field in the nip between each primary image forming member and the respective counter-rotating intermediate transfer member;

transferring electrostatically each said a single color toner image from each primary image forming member to the respective intermediate transfer member;

providing a moving web that has or supports a toner image receiving surface;

providing in each module a respective transfer roller that rotates in the same direction as each said a rotating primary image forming member;

in each module nipping the moving web between each said an intermediate transfer member and each said a respective transfer roller to form a respective second transfer nip, the web moving parallel to the tangential direction of the transfer roller in the respective second transfer nip;

providing an electric transfer field in the nip between each intermediate transfer member and each respective transfer roller;

in each respective second transfer nip, electrostatically transferring from each respective ITM to the receiving surface each said a single color toner image, so that each single color toner image is deposited on the receiving surface in registration so as to form a composite image with the single color toner images previously transferred to the receiving surface by the ITMs of each preceding module.

33B. A reproduction method according to Paragraph 33A wherein the Poisson's ratio of the conformable layer has a value between 0.20 and 0.35.

34A. A reproduction method including:

providing one or more electrostatographic modules, each module including a rotating primary image forming member (PIFM) drum or roller;

providing in each module a counter-rotating intermediate transfer member (ITM) drum or roller including: a rigid cylindrical core member, an elastically deformable structure including one or more layers surrounding the core member, wherein the said an elastically deformable structure has an operational or effective Poisson's ratio in a range of 0.2 to 0.4.

forming a first pressure transfer nip between each said a rotating primary image forming member and each said a counter-rotating intermediate transfer member;

forming a single color toner image on each primary image forming member;

providing an electric transfer field in the nip between each primary image forming member and the respective counter-rotating intermediate transfer member;

transferring electrostatically each said a single color toner image from each primary image forming member to the respective intermediate transfer member;

providing a moving web including a dielectric material that has or supports a toner image receiving surface;

providing in each module a respective transfer roller that rotates in the same direction as each said a rotating primary image forming member;

in each module nipping the moving web between each said an intermediate transfer member and each said a respective transfer roller to form a respective second transfer nip, the web moving parallel to the tangential direction of the transfer roller in the respective second transfer nip;

providing an electric transfer field in the nip between each intermediate transfer member and each respective transfer roller;

in each respective second transfer nip, electrostatically transferring from each respective ITM to the receiving surface each said a single color toner image, so that each single color toner image is deposited on the receiving surface in registration so as to form a composite image with the single color toner images previously transferred to the receiving surface by the ITMs of each preceding module.

34B. A reproduction method according to Paragraph 34A wherein the operational or effective Poisson's ratio of the elastically deformable structure has a value between 0.25 and 0.35.

34B. A reproduction method according to Paragraph 34B wherein the operational or effective Poisson's ratio of the elastically deformable structure has a value between 0.28 and 0.32.

35. The roller according to Paragraph 1B wherein the stiffening layer has a thickness less than 500 micrometers.

36. The roller according to Paragraph 35 wherein the stiffening layer has a thickness in a range of 10–200 micrometers.

37. The roller according to Paragraph 1B wherein the stiffening layer has a Young's modulus greater than 0.1 GPa.

38. The roller according to Paragraph 37 wherein the stiffening layer has a Young's modulus in a range of 50–300 GPa.

The invention has been described in detail with reference to presently preferred embodiments, but it will be understood that variations and modifications can be effected within the spirit and scope of the invention.

What is claimed is:

1. An intermediate transfer roller for use in a reproduction apparatus comprising:

a rigid cylindrical core member;

at least one layer of an elastically deformable structure surrounding the core member, said elastically deformable structure having an effective Poisson's ratio in a range of 0.2 to 0.4; and wherein said intermediate transfer roller is capable of receiving an image.

2. The transfer roller of claim 1 wherein the effective Poisson's ratio is determined during operation.

3. The transfer roller of claim 1 wherein the elastically deformable structure surrounding the core member further comprises:

a conformable layer surrounding the core member;

a compliant blanket layer surrounding and adhered to the conformable layer;

a thin hard outer layer formed on the compliant blanket layer; and wherein Poisson's ratio of the conformable layer has a value less than 0.4.

4. The roller of claim 3 further comprising a thin flexible electrically conductive electrode layer adhered to the conformable layer.

5. The roller of claim 3 further comprising a stiffening layer surrounding and in intimate contact with the conformable layer.

6. The roller according to claim 1 further comprising:

an indicia located on a surface of the roller; and wherein the indicia is provided on the roller to indicate a parameter relative to performance of the roller that can be read, sensed or detected by an indicia detector, either visually, electrically, mechanically, optically, magnetically, or by means of a radio frequency.

7. An intermediate transfer roller as defined by claim 3 further comprising an electrically conductive layer between the conformable layer and the compliant blanket layer.

8. An intermediate transfer roller as defined by claim 7 wherein the conformable layer further comprises a foam in which the solid phase has a Young's modulus in a range of $1\times10^6$ Pa to $2\times10^9$ Pa, and the conformable layer further having a Poisson's ratio less than 0.4 and a thickness between 3 mm and 25 mm; the compliant blanket layer has a Poisson's ratio between 0.45 and 0.50, a thickness in a range of 0.5 mm to 5 mm, an electrical resistivity in a range $10^7$ ohm-cm to $10^{11}$ ohm-cm, and a Young's modulus in a range of 0.5 MPa to 50 MPa; and, the thin hard outer layer has a Young's modulus greater than 50 MPa, a thickness between 0.1 micrometer and 20 micrometers, and a resistivity at least as high as the resistivity of the compliant blanket layer.

9. The roller according to claim 7 further comprising:

an indicia located on a surface of the roller; and wherein the indicia is provided on the roller to indicate a parameter relative to the roller that can be read, sensed or detected by an indicia detector, either visually, mechanically, electrically, optically, magnetically, or by means of a radio frequency.

10. The roller according to claim 7 further comprising a stiffening layer surrounding the conformable layer wherein the stiffening layer has a thickness less than 500 micrometers and a Young's modulus greater than 0.1 Gpa.

11. An intermediate transfer member for use in a reproduction apparatus comprising:

a rigid cylindrical core member;

a sleeve member surrounding the core member, wherein the sleeve member comprises a strengthening band in the form of a tubular belt, and an elastically deformable structure including one or more layers formed on the strengthening band; and wherein the elastically deformable structure has an operational or effective Poisson's ratio in a range of 0.2 to 0.4, and wherein said intermediate transfer member is capable of receiving an image.

12. The intermediate transfer member as defined in claim 11 wherein the sleeve member comprises:

a conformable layer formed on the strengthening band;

an optional thin flexible electrically conductive electrode layer adhered to the conformable layer;

a compliant blanket layer surrounding and adhered to the electrode layer; and a thin hard outer layer formed on the compliant blanket layer.

13. The intermediate transfer member as defined in claim 12 wherein the strengthening band has a Young's modulus in a range of 100–300 GPa, a thickness in a range of 20 micrometers–500 micrometers; the conformable layer is a foam in which the solid phase has a Young's modulus in a range of $1\times10^6$ Pa to $2\times10^9$ Pa.

14. The intermediate transfer member as defined in claim 12 wherein the conformable layer has a Poisson's ratio less than 0.4 and a thickness between 3 mm and 25 mm.

15. The intermediate transfer member as defined in claim 12 wherein the stiffening layer has a thickness less than 500 micrometers and a Young's modulus greater than 0.1 Gpa.

16. The intermediate transfer member as defined in claim 12 the compliant blanket layer has a Poisson's ratio between 0.45 and 0.50, a thickness in a range of 0.5 mm to 5 mm, an electrical resistivity in a range $10^7$ ohm-cm to $10^{11}$ ohm-cm, and a Young's modulus in a range of 0.5 MPa to 50 Mpa.

17. The intermediate transfer member as defined in claim 12 wherein the thin hard outer layer has a Young's modulus greater than 50 MPa, a thickness between 0.1 micrometer and 20 micrometers, and a resistivity at least as high as the resistivity of the compliant blanket layer.

18. The intermediate transfer member as defined in claim 12 wherein: the strengthening band has a Young's modulus in a range of 100–300 GPa, and a thickness preferably in a range of 20 micrometers–500 micrometers; the conformable layer is a foam in which the solid phase has a Young's modulus in a range of $1\times10^6$ Pa to $2\times10^9$ Pa, and the conformable layer further having a Poisson's ratio less than 0.4 and a thickness between 3 mm and 25 mm; the compliant blanket layer has a Poisson's ratio between 0.45 and 0.50, a thickness in a range of 0.5 mm to 5 mm, an electrical resistivity in a range $10^7$ ohm-cm to $10^{11}$ ohm-cm, and a Young's modulus in a range of 0.5 MPa to 50 MPa; and, the thin hard outer layer has a Young's modulus greater than 50 MPa, a thickness between 0.1 micrometer and 20 micrometers, and a resistivity at least as high as the resistivity of the compliant blanket layer.

19. A method of forming an intermediate transfer roller for use in a reproduction apparatus comprising the steps of providing a rigid cylindrical core member with at least one layer of an elastically deformable structure surrounding the core member, the elastically deformable structure having an effective Poisson's ratio in a range of 0.2 to 0.4, and wherein said intermediate transfer roller is capable of receiving an image.

20. The method of claim 19 wherein the step of providing further comprises providing the elastically deformable structure surrounding the core member such that the conformable layer has a compliant blanket layer surrounding and adhered to the conformable layer, with a thin hard outer layer formed on the compliant blanket layer; and wherein Poisson's ratio of the conformable layer has a value less than 0.4.

* * * * *